US010247401B2

(12) United States Patent
Noh et al.

(10) Patent No.: US 10,247,401 B2
(45) Date of Patent: Apr. 2, 2019

(54) LIGHTING DEVICE

(71) Applicant: FEELUX CO., LTD., Gyeonggi-do (KR)

(72) Inventors: Si Chung Noh, Gyeonggi-do (KR); Beom Yeon Cho, Seoul (KR); Ha Young Jhun, Gyeonggi-do (KR)

(73) Assignee: FEELUX CO., LTD., Gyeonggi-Do (KR)

( * ) Notice: Subject to any disclaimer, the term of this patent is extended or adjusted under 35 U.S.C. 154(b) by 204 days.

(21) Appl. No.: 15/106,329

(22) PCT Filed: May 14, 2014

(86) PCT No.: PCT/KR2014/004337

§ 371 (c)(1),
(2) Date: Jun. 20, 2016

(87) PCT Pub. No.: WO2015/093694

PCT Pub. Date: Jun. 25, 2015

(65) Prior Publication Data

US 2016/0356470 A1 Dec. 8, 2016

(30) Foreign Application Priority Data

Dec. 20, 2013 (KR) ..... 10-2013-0160271
Mar. 17, 2014 (KR) ..... 10-2014-0031307

(51) Int. Cl.
*H01R 12/00* (2006.01)
*F21V 23/06* (2006.01)
(Continued)

(52) U.S. Cl.
CPC ..... *F21V 23/06* (2013.01); *F21S 4/28* (2016.01); *F21V 15/01* (2013.01); *F21V 19/003* (2013.01);
(Continued)

(58) Field of Classification Search
CPC ..... H01R 33/08; H01R 33/94; H01R 12/62
See application file for complete search history.

(56) References Cited

U.S. PATENT DOCUMENTS 3,832,503 A * 8/1974 Crane ..... H01R 25/142 200/51 R
5,639,246 A * 6/1997 Holmes ..... H01R 33/46 439/35
(Continued)

FOREIGN PATENT DOCUMENTS

CN 202392556 U 8/2012
JP 1997-050703 A 2/1997
(Continued)

OTHER PUBLICATIONS

International Search Report for PCT/KR2014/004337.
(Continued)

*Primary Examiner* — Tho D Ta
(74) *Attorney, Agent, or Firm* — The PL Law Group, PLLC

(57) ABSTRACT

A lighting device includes an illumination part, and a power connection part adapted to transfer outside power to the illumination part and for preventing an electrical short circuit. The power connection part includes at least two power connectors which are separated from each other and into which the external power is transferred and an insulator provided between the at least two power connectors and coupled with the at least two power connectors.

15 Claims, 24 Drawing Sheets

(51) Int. Cl.

| | |
|---|---|
| ***F21V 21/005*** | (2006.01) |
| ***F21V 23/00*** | (2015.01) |
| ***F21S 4/28*** | (2016.01) |
| ***F21V 29/70*** | (2015.01) |
| ***F21V 15/01*** | (2006.01) |
| ***F21V 19/00*** | (2006.01) |
| ***F21V 29/74*** | (2015.01) |
| *H01R 12/62* | (2011.01) |
| *H01R 33/08* | (2006.01) |
| *H01R 33/94* | (2006.01) |
| *F21S 2/00* | (2016.01) |
| *F21Y 103/10* | (2016.01) |
| *F21Y 115/10* | (2016.01) |
| *F21Y 103/33* | (2016.01) |
| *F21V 3/02* | (2006.01) |
| *F21V 17/10* | (2006.01) |
| *F21V 23/02* | (2006.01) |
| *F21Y 115/15* | (2016.01) |

(52) U.S. Cl.

CPC ..... *F21V 21/005* (2013.01); *F21V 23/001* (2013.01); *F21V 29/70* (2015.01); *F21V 29/74* (2015.01); *F21S 2/00* (2013.01); *F21V 3/02* (2013.01); *F21V 17/105* (2013.01); *F21V 23/02* (2013.01); *F21Y 2103/10* (2016.08); *F21Y 2103/33* (2016.08); *F21Y 2115/10* (2016.08); *F21Y 2115/15* (2016.08); *H01R 12/62* (2013.01); *H01R 33/08* (2013.01); *H01R 33/94* (2013.01)

(56) References Cited

U.S. PATENT DOCUMENTS

| | | | | |
|---|---|---|---|---|
| 6,866,394 | B1 | 3/2005 | Hutchins et al. | |
| 7,506,995 | B2 | 3/2009 | Thomas et al. | |
| 7,909,483 | B2 | 3/2011 | Jacobs et al. | |
| 8,232,724 | B2 * | 7/2012 | Mostoller | F21S 8/031 313/512 |
| 8,313,212 | B1 | 11/2012 | Mayer et al. | |
| 8,851,717 | B2 | 10/2014 | Verbrugh | |
| 9,360,167 | B2 | 6/2016 | Sadato et al. | |
| 2005/0006961 | A1 * | 1/2005 | Shen | H02K 7/1853 310/50 |
| 2011/0235319 | A1 * | 9/2011 | Fukano | F21V 23/06 362/217.14 |

FOREIGN PATENT DOCUMENTS

| | | | |
|---|---|---|---|
| JP | 2007-273213 | A | 10/2007 |
| JP | 2011-119771 | A | 6/2011 |
| JP | 2012-064391 | A | 3/2012 |
| KR | 10-2007-0119128 | A | 12/2007 |
| KR | 10-2009-0039261 | A | 4/2009 |
| KR | 2009-0120885 | A | 11/2009 |
| KR | 10-2011-0095437 | A | 8/2011 |
| KR | 10-2011-0130014 | A | 12/2011 |
| KR | 10-2012-0006859 | A | 1/2012 |
| KR | 10-2013-0003158 | A | 1/2013 |
| KR | 10-2013-0063750 | A | 6/2013 |
| WO | WO 2011/139768 | A2 | 11/2011 |
| WO | WO 2015/093694 | A1 | 6/2015 |

OTHER PUBLICATIONS

Supplementary European Search Report for EP 14 87 1831, dated Aug. 23, 2017 from European patent office in a counterpart European patent application.

* cited by examiner

LIGHTING DEVICE

CROSS REFERENCE TO RELATED APPLICATIONS AND CLAIM OF PRIORITY

This application claims benefit under 35 U.S.C. 119(e), 120, 121, or 365(c), and is a National Stage entry from International Application No. PCT/KR2014/004337, filed May 14, 2014, which claims priority to the benefit of Korean Patent Application No. 10-2013-0160271 filed on Dec. 20, 2013 and 10-2014-0031307 filed on Mar. 17, 2014 in the Korean Intellectual Property Office, the entire contents of which are incorporated herein by reference.

TECHNICAL FIELD

The present invention relates to a lighting device, and more particularly, to a lighting device that emits light for illumination and has a simplified construction facilitating assemble and disassemble of the device.

BACKGROUND

In general, a lighting lamp using LEDs is advantageous for generating a high-brightness light with a low-capacity power supply, and has thus found a range of applications such as decorating or indoor lighting lamps. In particular, an LED lighting lamp in form of a conventional fluorescent lamp is known to combine a main body made of aluminum materials, where an LED module and a PCB are mounted, with a tubular fluorescent cover.

Technical background of the present invention is also disclosed in Korean Patent Application Publication No. 2009-0120885 (Published on Nov. 25, 2009 titled as "LED Lighting Lamp").

SUMMARY

The present invention is directed to provide a lighting device which is easy to assemble and disassemble, is easy to install, and features accurate power supply leading to high reliability.

Further, the present invention is directed to provide a lighting device which offers replacement conveniences of damaged parts.

Further, the present invention is directed to provide a lighting device which has a design allowing the combination of multiple lighting devices operated by a single power supply.

According to an aspect of the present disclosure, there is provided a lighting device, comprising: an illumination part, and a power connection part adapted to supply external power to the illumination part and for preventing an electrical short circuit.

In one aspect, the power connection part comprises a pair of power connectors where the outside power is transferred, and a first insulation block arranged between the power connectors to separate and space them apart from each other.

In one aspect, the lighting device further comprises a power supply part adapted to supply outside power to the power connection part.

In one aspect, the power supply part electrically connects the power connection part to another neighboring power connection part, and the power supply part comprises a power supply pin protruded outward from the power connection part.

In one aspect, the power supply part is fastened to the power connection part, and comprises a pair of power supply hooks adapted to supply outside power, and supporting plates for fixing the power supply hooks, respectively.

In one aspect, the power supply part is comprised of a pair of power supply parts arranged in parallel, which are connected by a flexible connecting member.

In one aspect, the power supply pins are arranged in locking grooves formed in the power connectors.

In one aspect, an auxiliary groove is formed about the locking, and a pressure member is provided in the auxiliary groove to prevent the escape of the power supply pin fitted in the locking groove.

In one aspect, the power supply pin is flexible.

In one aspect, the power supply part includes electrodes electrically connected with the power connection part, and magnets arranged in the power connection part, the magnets and the electrodes being attached together.

In one aspect, the magnets are built in the power connection part, and the power connection part and the electrodes make a surface contact.

In one aspect, the magnets are attached to one side of the power connection part, and the magnets and the power connection part make a surface contact.

In one aspect, the power supply part is arranged at a target fixed object and comprised of a conducting tape connected to an outside power source.

In one aspect, there are multiple power connection parts, and each is spaced from the nearest neighboring power connection part by a second insulation block.

In one aspect, the power supply part is arranged at a distance from the power connection part, and includes a coil portion to which outside power is supplied and a magnet arranged within the coil portion.

A lighting device according to the present invention has a simplified structure, allowing easy assembly and disassembly. Also, it is designed to be simply and easily fitted into a bracket locked in a target fixed object.

Further, in the lighting device of present invention, the illumination part and the power connection part are modularized, thereby facilitating the installation process.

Further, in the lighting device of present invention, the power connector and the power supply part make a line or surface contact with each other, resulting in accurate supply of power as well as high-reliability products.

Further, in the lighting device of present invention, each part can easily be attached and detached. If any damage occurs, the corresponding damaged part can be replaced.

Further, in the lighting device of present invention, the illumination part may have modified shapes so as to provide various types of lighting structures. Also, multiple lighting devices can be connected to each other and operated by a single power supply, and when connected, the direction may be changed in many ways to embody various types of lighting structures suitable for the surroundings.

DETAILED DESCRIPTION

Figure 1:
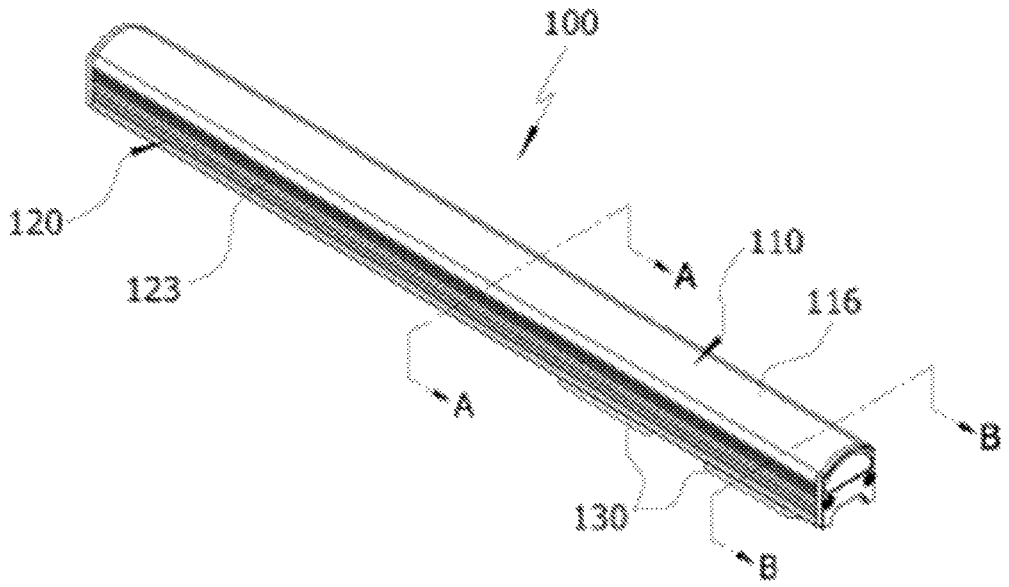
FIG. 1 is a perspective view of a lighting device according to first exemplary embodiment of the present invention.

Hereinafter, the present disclosure will now be described in detail with reference to the accompanying drawings.

It should be noted that the thickness of lines or the dimensions of components shown in the drawings may have been magnified for the clarity and convenience of reference. Also, terms used in the following description are defined by considering relevant functions of components in the present invention, which may vary depending on the intention of a user or operator, or according to the conventional practice. Hence, those terms will be defined based on the contents of this application in general. Furthermore, any reference to singular includes plural embodiments, and any reference to more than one component or step may include a singular embodiment or step. Also, any reference to attached, fixed, connected or the like may include permanent, removable, temporary, partial, full and/or any other possible attachment option. Additionally, any reference to without contact or the like may also include reduced contact or minimal contact.

Figure 2:
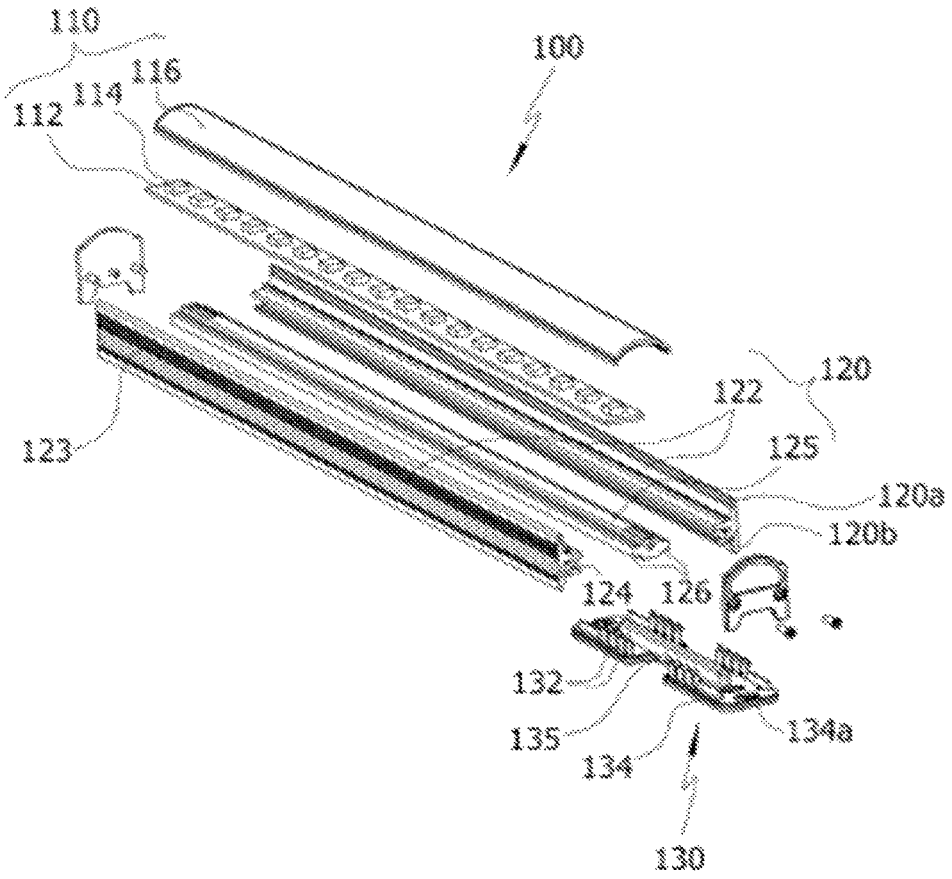
FIG. 2 is an exploded perspective view of a lighting device according to a first exemplary embodiment of present invention.
Figure 3:
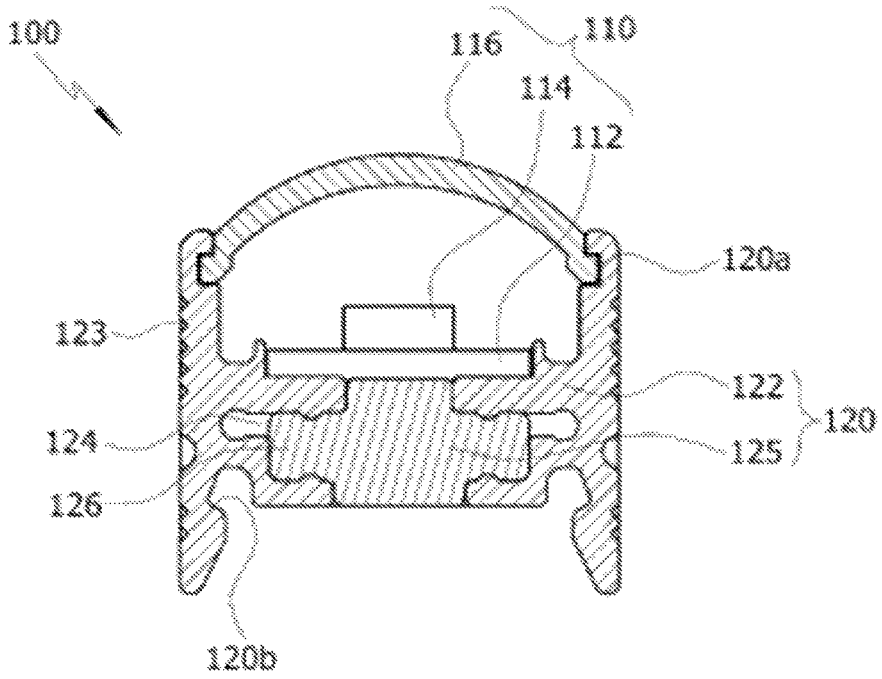
FIG. 3 is a cross-sectional view taken along line A-A of FIG. 1.
Figure 4:
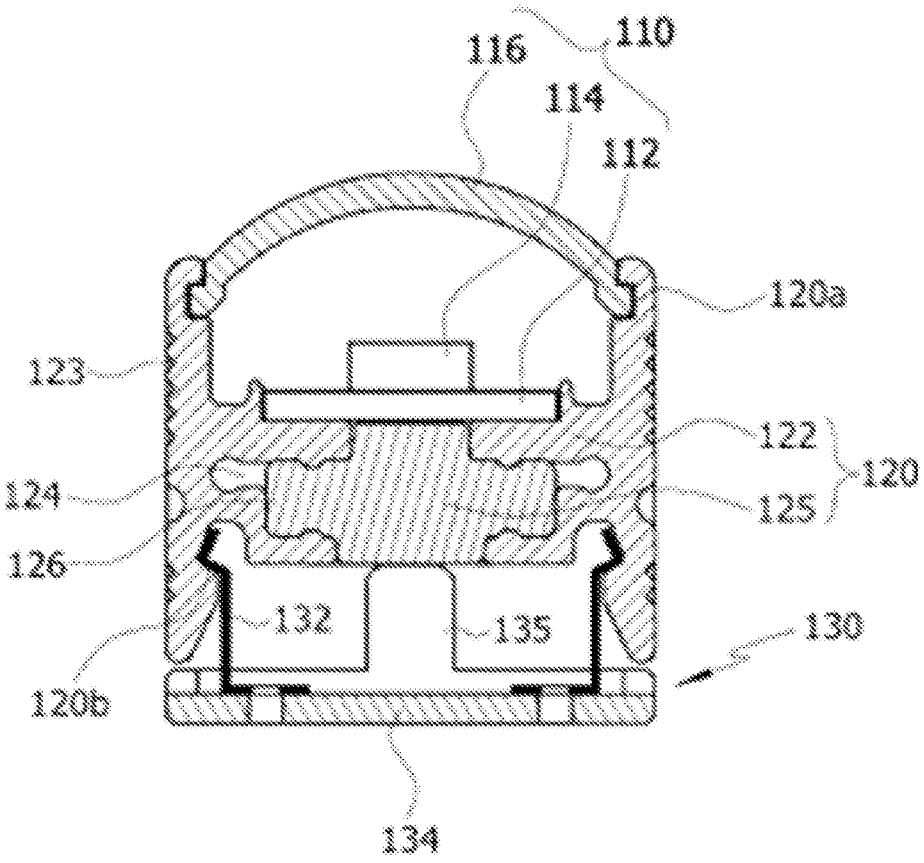
FIG. 4 is a cross-sectional view taken along line B-B of FIG. 1.
Figure 5:
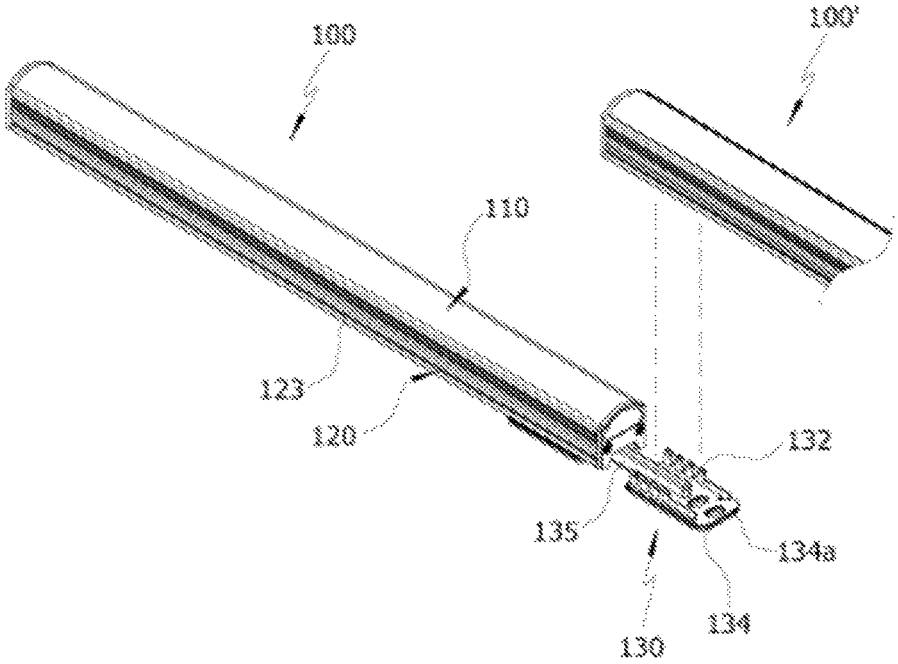
FIG. 5 is a perspective view showing a state where the lighting device according to the first exemplary embodiment of the present invention is joined to a neighboring lighting device.
Figure 6:
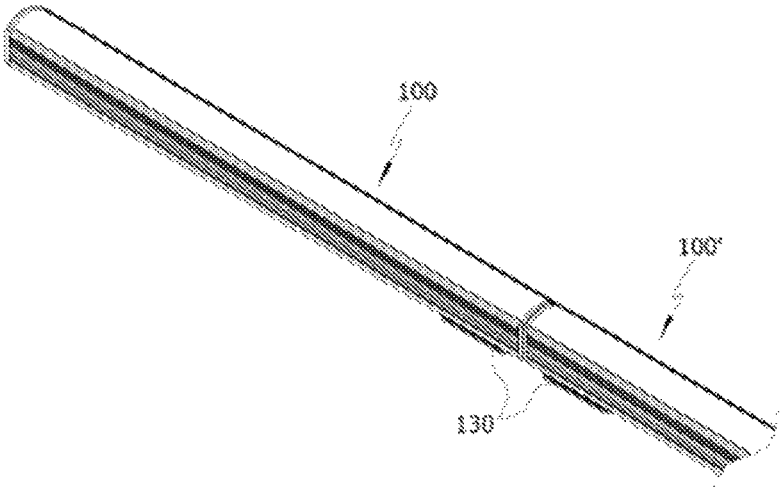
FIG. 6 is a perspective view showing a state where the lighting device according to the first exemplary embodiment of the present invention is linearly joined to a neighboring lighting device.
Figure 7:
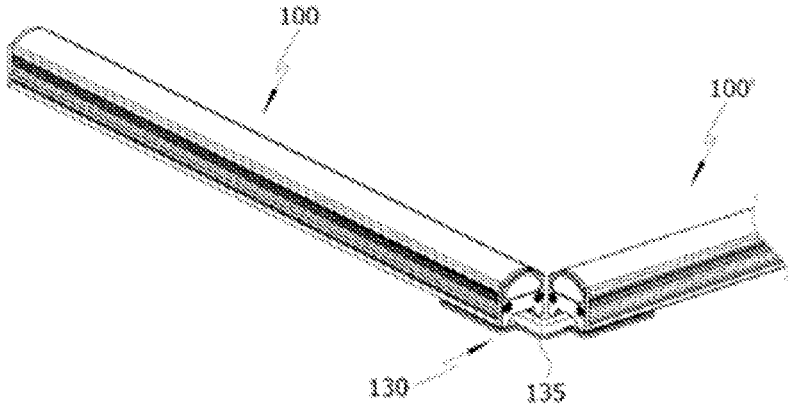
FIG. 7 is a perspective view showing a state where the lighting device according to the first exemplary embodiment of the present invention is non-linearly joined to a neighboring lighting device.

FIG. 1 is a perspective view of a lighting device according to first exemplary embodiment of the present invention, FIG. 2 is an exploded perspective view of the lighting device according to the first exemplary embodiment of the present invention, FIG. 3 is a cross-sectional view taken along line A-A of FIG. 1, FIG. 4 is a cross-sectional view taken along line B-B of FIG. 1, FIG. 5 is a perspective view showing a state where the lighting device according to the first exemplary embodiment of the present invention is joined to a neighboring lighting device, FIG. 6 is a perspective view showing a state where the lighting device according to the first exemplary embodiment of the present invention is linearly joined to a neighboring lighting device, and FIG. 7 is a perspective view showing a state where the lighting device according to the first exemplary embodiment of the present invention is non-linearly joined to a neighboring lighting device.

Referring to FIG. 1 through FIG. 7, the lighting device 100 according to the first exemplary embodiment of the present invention includes an illumination part 110 and a power connection part 120.

The illumination part 110 includes a circuit board 112 electrically connected to the power connection part 120, a light source unit (lamp) 114 provided in the circuit board 112, and a diffusion member 116 provided on the front face of the light source unit 114 and adapted to diffuse light emitted from the light source unit 114.

All kinds of circuit parts (not shown) for driving the light source unit 114 are mounted on the circuit board 112. The circuit board 112 is electrically connected to the power connection part 120 via which power for driving the light source unit 114 is supplied.

The light source unit 114 is turned on by converting electrical energy is converted into light energy, and may be formed of either LED (Light Emitting Diode) or OLED (Organic Light Emitting Diode).

The diffusion member 116 is arranged on the front face of the circuit board 112 and of the light source unit 114 so as to protect the circuit board 112 and the light source unit 114 against shocks and foreign matters from outside, and serves to diffuse the light of the light source unit 114 when it is turned on.

Moreover, the diffusion member 116 may be slidably connected on top of the power connection part 120 such that its attachment and detachment may be facilitated. Projected shoulders 120*a* are formed on either side of the power connection part 120, and both sides of the diffusion member 116 are configured correspondingly to the projected shoulders 120*a* to be united or engaged together.

Although now shown, a flexible display may be applied to the circuit board 112. In this case, the diffusion member 116 on the front face may be eliminated. The flexible display may be at least one of flexible OLEDs or flexible LEDs, and it may display information or images.

The illumination part 110 is non-polar, and it can therefore be attached, regardless of the orientation when the power connection part 120 and the power supply part 130 are installed, which will be described later.

The power connection part 120, which is adapted to supply or transfer external power to the illumination part 110 and to prevent an electrical short circuit, is made of electrically conducting materials to enable the transfer of current supplied from the power supply part 130 (to be described later) to the circuit board 112, and further it may be in contact with the circuit board 112.

This power connection part 120 includes a pair of power connectors 122 where the outside power is transferred, and a first insulation block 125 arranged between the power connectors 122 to separate and space them apart from each other.

The power connectors 122 may be symmetrically located with respect to the first insulation block 125 not to be bonded together. The power connectors 122 are made of aluminum materials, and each of the power connectors 122 has the first insulation block 125 at the center. Engagement lugs 126 are formed on either lateral face of the first insulation block 125, and corresponding engagement grooves 124 where the engagement lugs 126 fit into, respectively, are formed in the power connectors 122. The first insulation block 125 is an insulator arranged between the pair of power connectors 122 to separate and space the power connectors 122 apart from each other, thereby preventing an electrical short circuit.

While the engagement lugs 126 and the engagement grooves 124 in this embodiment are formed in an inverted trapezoid shape, diverging upwardly, they can be modified into any design. In addition, the engagement lugs 126 and the engagement grooves 124 may be interchangeably arranged.

Part of each lateral face of the power connector 122 has an uneven-shaped heat dissipation portion 123 with protrusions and depressions for increasing the contact surface with air. The heat dissipation portion 123 serves to dissipate the heat generated in the illumination part 110.

The power connection part 120 receives outside power via the power supply part 130. As shown in FIG. 2 or FIG. 4, the power supply part 130 is fastened to the power connection part 120 and includes a pair of power supply hooks 132 adapted to supply outside power, and supporting plates 134 for fixing the power supply hooks 132, respectively.

The power supply hooks 132 are made of metallic materials to be able to provide outside power, and are resilient to support the power connection part 120. The power connection part 120 has on its inner face projected shoulders 120*b* which are locked in corresponding outwardly bent end portions of the power supply hook 132.

The power supply part 130 is comprised of a pair of power supply parts arranged in parallel, and each of the power supply parts 130 is connected by a flexible connecting member 135. That is, the power supply part 130 can be connected to another lighting device as a pair of power supply hooks 132 are symmetrically formed, with a pair of power supply hooks 132 on one side being connected with another pair of power supply hooks 132 on the other side by the connecting member 135.

The supporting plate 134 to which the power supply hooks 132 are fixed are bent such that the power connection part 120 of the lighting device 100 on one side may be connected with the power connection part 120 of another neighboring lighting device 100', as shown in FIG. 7.

In other words, referring to FIG. 5 through FIG. 7, the lighting device 100 may be linearly or non-linearly joined to another lighting device via the power supply part 130. More specifically, to non-linearly join the lighting devices 100, 100' together, it is desirable to make the connecting member 135 adapted to interconnect the power supply parts 130 using flexible materials.

As the connecting member 135 may easily be bent by a user as described above, the non-linear joint can be created between the lighting device 100 and another lighting device 100'. While this embodiment illustrated the joint between two lighting devices, multiple, e.g. at least two, lighting devices can be joined in the same manner.

The following will now describe the operation and advantages of the lighting device according to the first exemplary embodiment of the present invention having the above structure.

As shown in FIG. 2 through FIG. 4, in the power connection part 120, the power connectors 122 are arranged on either side of the first insulation block 125, and the power connectors 122 and the first insulation block 125 are interlocked as the engagement lugs 126 are fitted into the engagement grooves 124. Further, the circuit board 112 of the illumination part 110 is electrically connected to the power connectors 122, and the light source unit 114 and circuit elements are mounted on the circuit board 112. Moreover, the diffusion member 116 and the projected shoulders 120*a* are interlocked on the outwardly protruded portions on the edges of the power connection part 120. The power connection part 120 and the illumination part 110 are modularized as described above.

As the power connectors 122 are separated and spaced apart from each other by the first insulation block 125, the occurrence of an electrical short circuit can be prevented. In this way, it is possible to accomplish stable power transfer, and to offer products with high stability.

The modularized power connection part 120 and illumination part 110 receive outside power from the power supply part 130. The power supply part 130 includes power supply hooks 132 coupled to the power connectors 122, and a supporting plate 134 adapted to secure each of the power supply hooks 132. That is, the illumination part 110 will turn on as the power connection part 120 receives power via the power supply hooks 132 which are engagedly connected with the projected shoulders 120*b* of the power connectors 122, and are connected with an outside power source to supply power to the power connection part 120. The supporting plate 134 has a fixing hole 134*a* through which the supporting plate 134 may be secured onto a separate target fixed object by means of a fastening member.

Moreover, the power supply part 130 can electrically connect the lighting device 100 to another lighting device 100'. In particular, this is possible as the power supply part 130 is comprised of a pair of power supply parts arranged in parallel, which are electrically connected by a connecting member 135, as shown in FIG. 5. As aforementioned, the lighting device 100 and another neighboring lighting device 100' may be linearly or non-linearly (e.g. bent) connected, as illustrated in FIG. 6 and FIG. 7.

The following will now describe a lighting device according to a second exemplary embodiment of the present invention, with reference to the drawings.

For the convenience of explanation, like or similar elements having the same function and configuration as those in the first exemplary embodiment will be designated by the same reference numerals, and further detailed description on them will be omitted accordingly.

Figure 8:
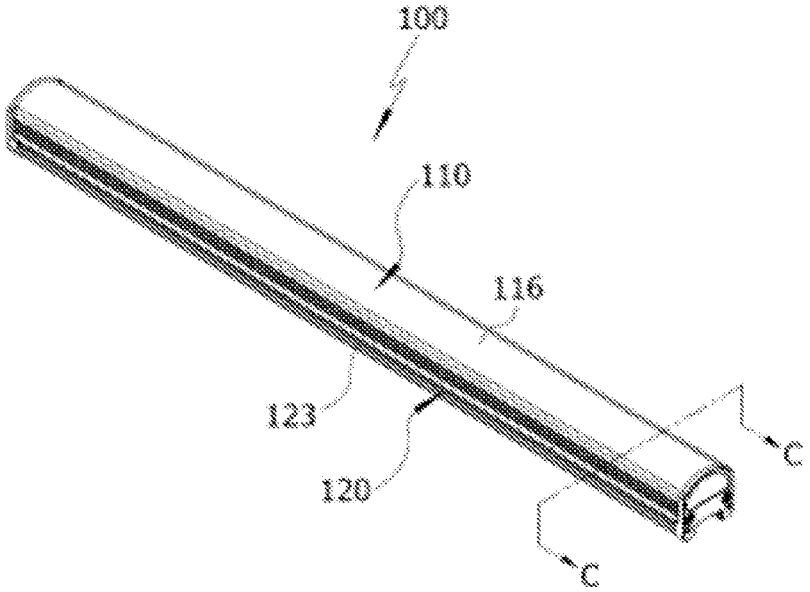
FIG. 8 is a perspective view of a lighting device according to a second exemplary embodiment of the present invention.
Figure 9:
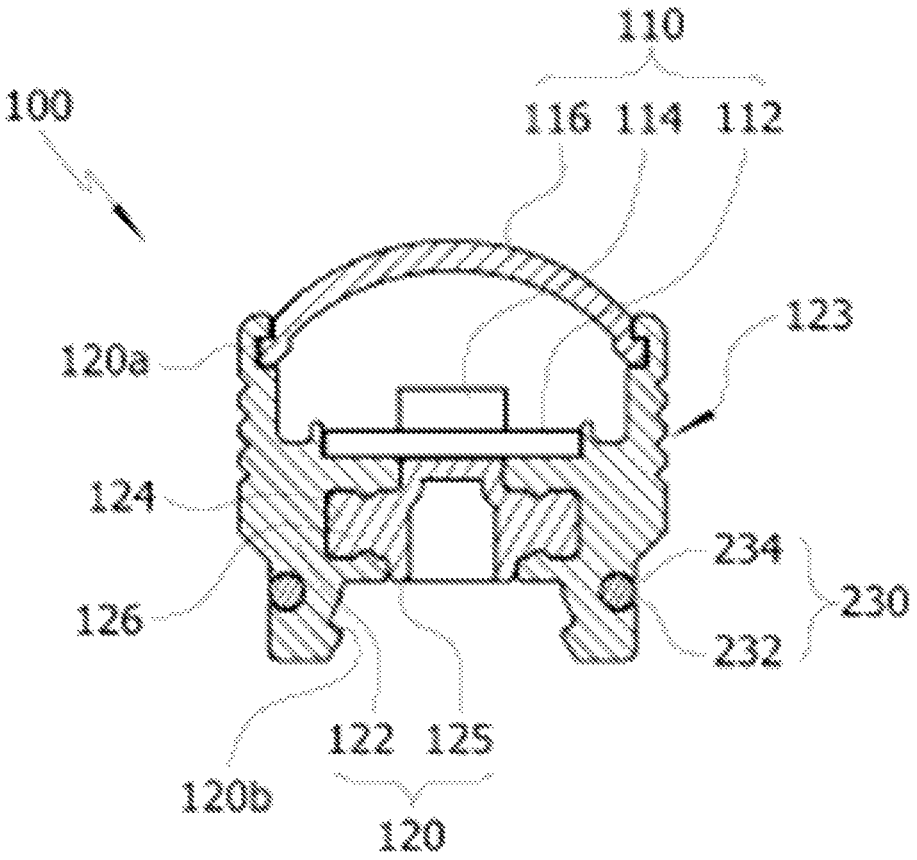
FIG. 9 is a cross-sectional view taken along line C-C of FIG. 8.
Figure 10:
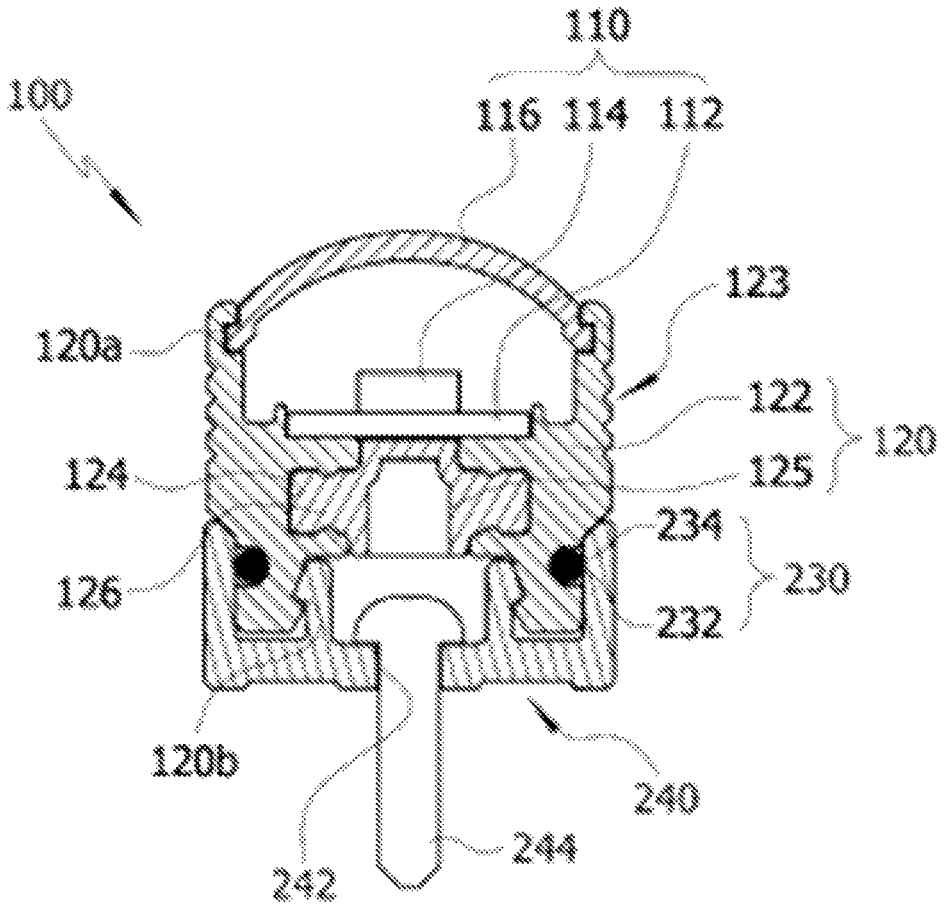
FIG. 10 is a cross-sectional view of the lighting device of FIG. 9, having a bracket coupled thereto.
Figure 11:
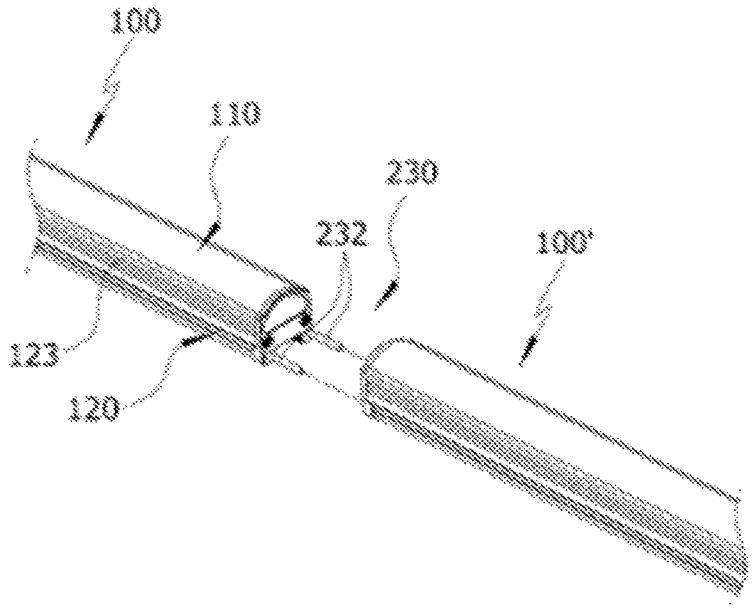
FIG. 11 is a perspective view showing a state where the lighting device according to the second exemplary embodiment of the present invention is linearly joined to a neighboring lighting device.
Figure 12:
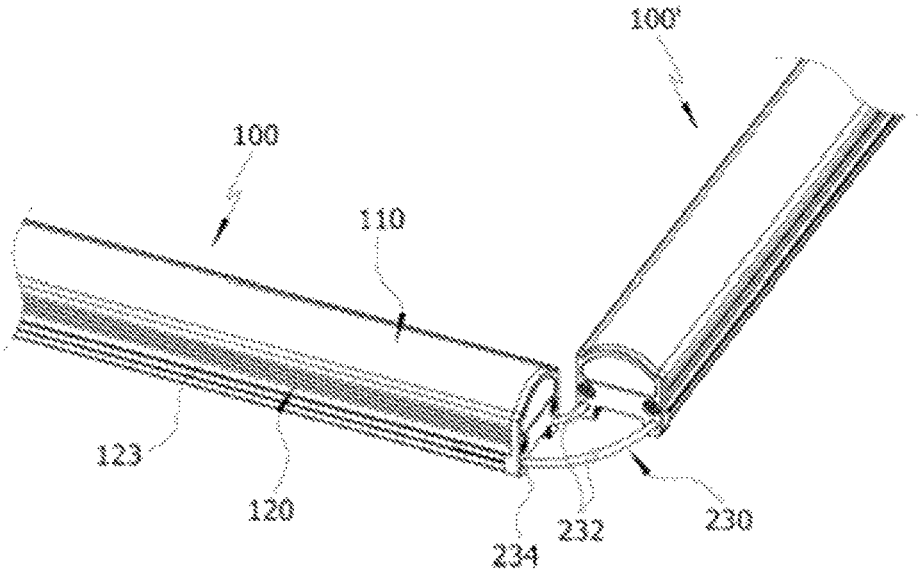
FIG. 12 is a perspective view showing a state where the lighting device according to the second exemplary embodiment of the present invention is non-linearly joined to a neighboring lighting device.

FIG. 8 is a perspective view of the lighting device according to the second exemplary embodiment of the present invention, FIG. 9 is a cross-sectional view taken along line C-C of FIG. 8, FIG. 10 is a cross-sectional view of the lighting device of FIG. 9, having a bracket coupled thereto, FIG. 11 is a perspective view showing a state where the lighting device according to the second exemplary embodiment of the present invention is linearly joined to a neighboring lighting device, and FIG. 12 is a perspective view showing a state where the lighting device according to the second exemplary embodiment of the present invention is non-linearly joined to a neighboring lighting device.

Referring to FIG. 8 through FIG. 12, the lighting device 100 according to the second exemplary embodiment of the present invention is similar to the first exemplary embodiment of the present invention, while the power supply part 230 includes power supply pins 232 outwardly exposed from the power connection part 120.

The power supply pins 232 are positioned in the engagement grooves 234 formed in the power connector 122. Alternatively, the power supply pins 232 may be unitarily formed with the power connector 122. In other words, the power connectors 122 and the power supply pins 232 are electrically connected to each other.

The engagement grooves 234 of a predetermined length may be formed on either lateral face of the power connector 122. This locking groove 234 may be formed in a wedge shape. When the locking groove 234 has a wedge shape, the power supply pin 232 and the locking groove 234 will get engaged with each other more strongly as the power supply pin 232 is inserted deeper into the locking groove 234, thereby allowing the power supply pin 232 to securely fixed in the locking groove 234 and further, preventing the escape of the power supply pin 232 therefrom.

The power supply pin 232 can also be adapted to connect the lighting device 100 with another lighting device 100', and to apply power to them. That is, one end of the power supply pin 232 is fitted into the locking groove 234 in one power connector 122, and the other end of the power supply pin 232 is fitted into the locking groove 234 in another power connector 122, thereby transferring power from one lighting device 100 to another lighting device 100' (see FIG. 11 and FIG. 12).

With this design the power supply pins 232 can transfer power to another lighting device 100, meaning that multiple lighting devices 100, 100' can be connected to each other and operated with a single power source. In addition, the power supply pins 232 are made of flexible materials, and this allows another lighting device 100' to be connected non-linearly in different orientations.

While the second exemplary embodiment illustrated connecting two lighting devices 100, the same principle may also be applied to connect multiple, e.g. at least two, lighting devices 100.

Meanwhile, the power connection part 120 can be supported by the bracket 240, as shown in FIG. 10. The bracket 240 is provided at one side of the power connection part 120 to support the power connection part 120. The bracket 240 is configured to surround the lower portion of the power connection part 120, and serves to prevent the escape of the power supply pin 232 from the locking groove 234. Specifically, the bracket 240 has an open front face, and an inner space for accommodation in which the power connection part 120 is held. Also, both lateral faces of the bracket 240 are tightly attached to the lateral face of the locking groove 234 where the power supply pin 232 is inserted, so as to prevent the escape of the power supply pin 232.

Moreover, the bracket 240 has multiple fastening holes 242 at the center such that the bracket 240 may be attached to the ceiling or wall using fastening members 244.

Figure 13:
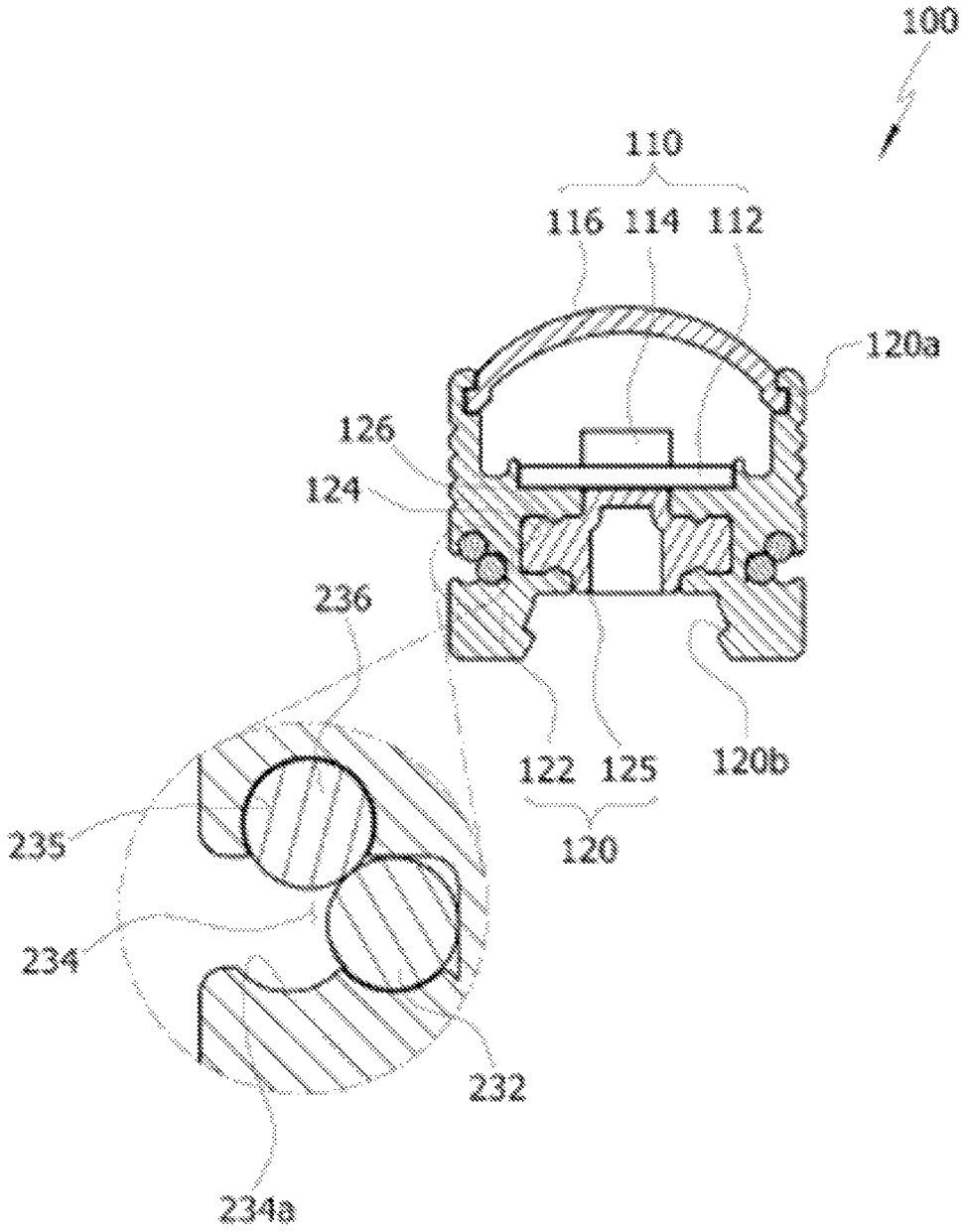
FIG. 13 is a cross-sectional view showing a modified version of the lighting device according to the second exemplary embodiment of the present invention.

FIG. 13 is a cross-sectional view showing a modified version of the lighting device according to the second exemplary embodiment of the present invention. This modified version according to the second exemplary embodiment has construction for the assembly of the power connection part 120 as well as for the prevention of its escape. An auxiliary groove 235 is formed about the locking groove 234, and a pressure member 236 is provided in the auxiliary groove 235 to prevent the escape of the power supply pin 232 fitted in the locking groove 234.

More specifically, an uneven section 234*a* is formed at the bottom face of the locking groove 234, and the power supply pin 232 is arranged in the concave portion of the uneven section 234*a* to prevent any movement of the power supply pin 232. The pressure member 236 affixed in the auxiliary groove 235 can apply pressure onto the power supply pin 232 inserted in the locking groove 234, thereby preventing the escape of the power supply pin 232 from the power connector 122.

Although not shown, the bracket 240 may be provided after auxiliary groove 235 and the pressure member 236 are applied.

The following will now describe the operation and advantages of the lighting device according to the second exemplary embodiment of the present invention having the above structure.

Similar to the first exemplary embodiment, the second exemplary embodiment also has a pair of power connectors 122, each being connected to the first insulation block 125. The power connectors 122 together with the illumination part 110 provided therein are modularized.

The power supply part 230 is comprised of power supply pins 232 fitted into the engagement grooves 234 of the power connector 122. That is, the power supply pins 232 are electrically connected to an outside power source so as to supply external power to the power connector 122. Alternatively, the power supply pins 232 may be unitarily formed with the power connectors 122.

The power supply pins 232 may be extended and electrically connected to another lighting device 100', as shown in FIG. 11 and FIG. 12. Further, the power supply pins 232 are made of flexible materials, and this allows another lighting device 100' to be arranged non-linearly in different orientations. In other words, multiple lighting devices 100 can be connected in different orientations by bending the flexible power supply pins 232, so as to obtain various types of lighting fixtures.

The auxiliary groove 235 is formed about the locking groove 234 into which the power supply pin 232 is fitted. The auxiliary groove 235 is useful for improving assembly of the power supply pin 232, and has the pressure member 236 to prevent the escape of the power supply pin 232 once it is fitted into the locking groove 234.

The power connection part 120 may be affixed to a certain location by means of the bracket 240. The bracket 240 may be secured onto a target fixed object by means of a separate fastening member 244, and the power connection part 120 is hooked and held in the bracket 240 by the projected shoulders 120*b*. Then both lateral faces of the bracket 240 come into abutment with both lateral faces of the power connector 122 such that the power supply pins 232 inserted into the engagement grooves 234 cannot escape therefrom.

The following will now describe a lighting device according to a third exemplary embodiment of the present invention, with reference to the drawings.

For the convenience of explanation, like or similar elements having the same function and configuration as those in the first exemplary embodiment will be designated by the same reference numerals, and further detailed description on them will be omitted accordingly.

Figure 14:
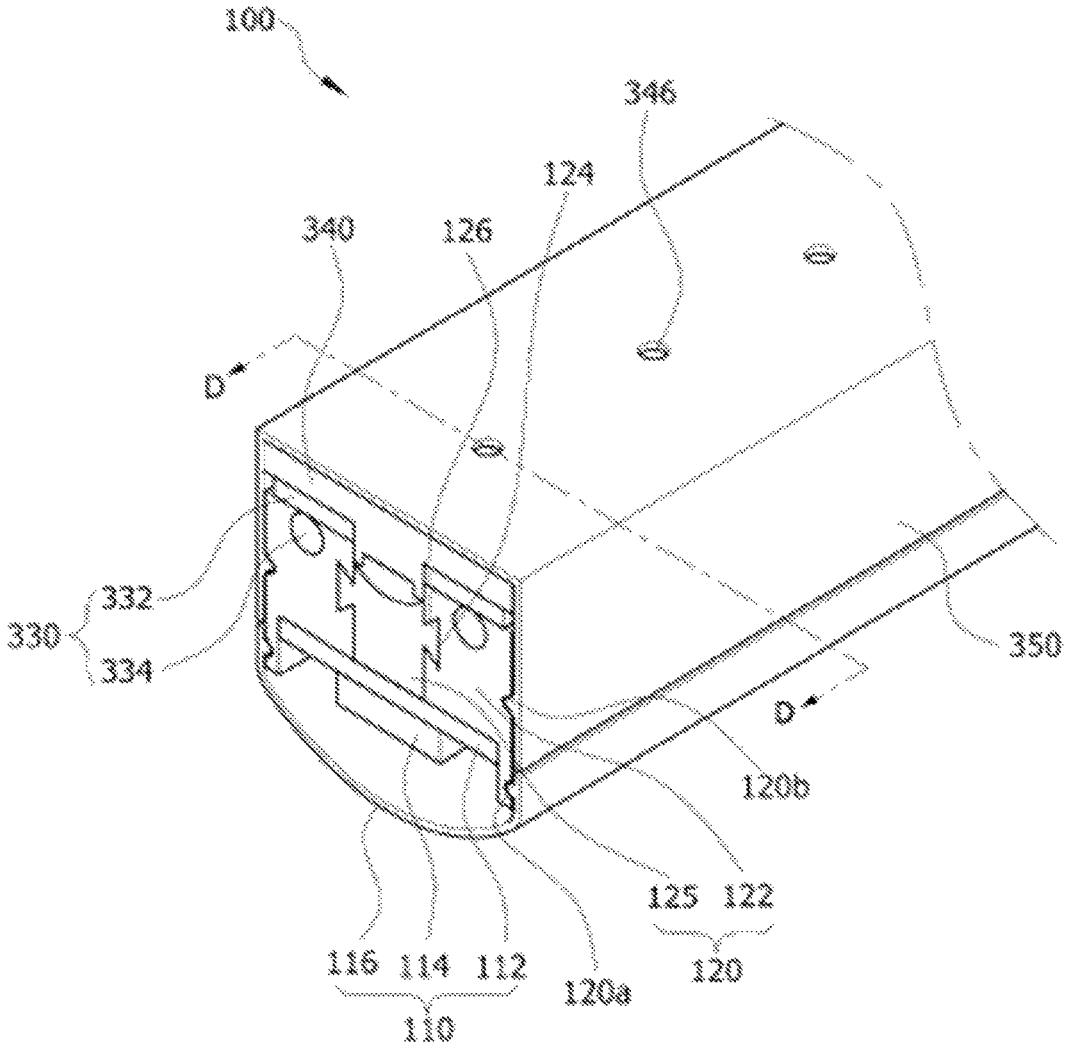
FIG. 14 is a perspective view of a lighting device according to a third exemplary embodiment of the present invention.
Figure 15:
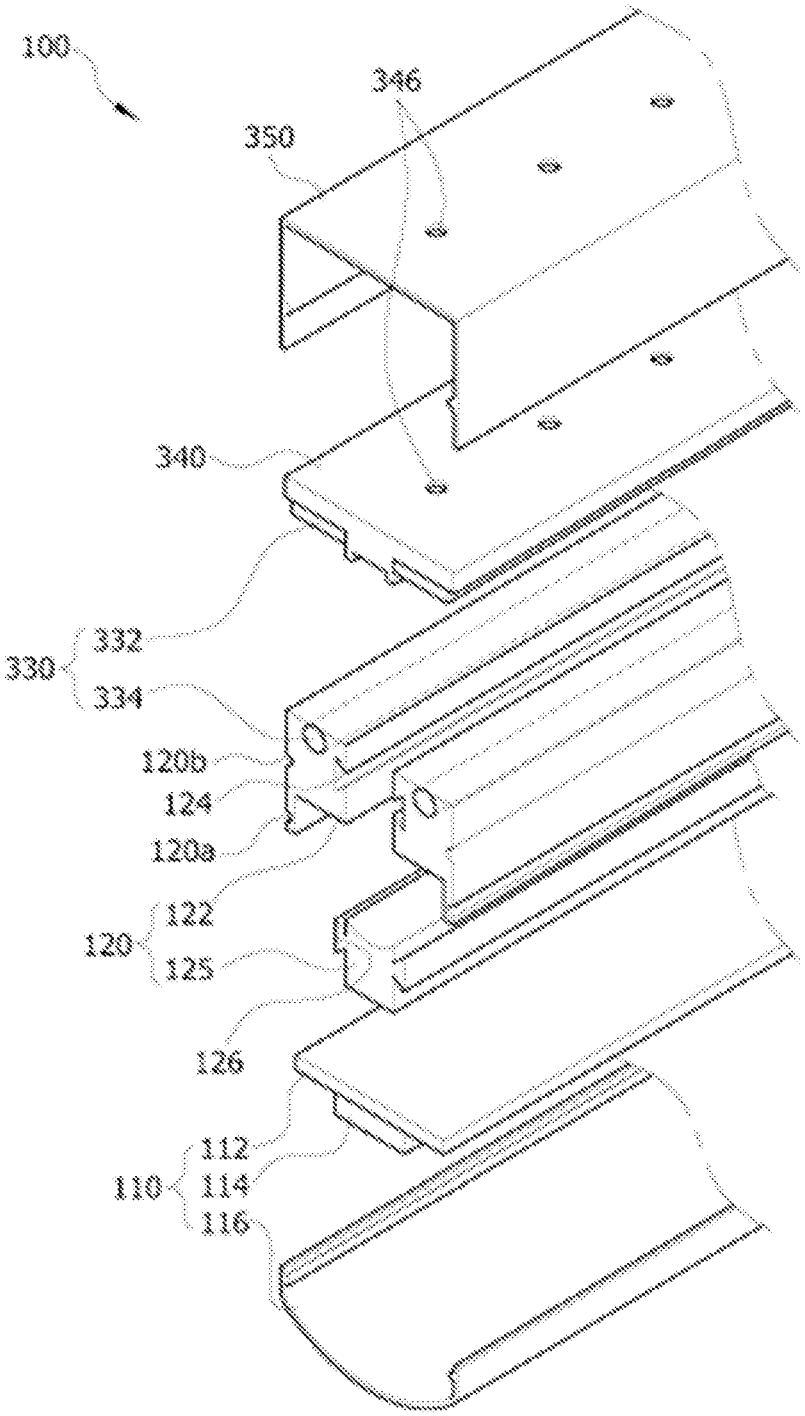
FIG. 15 is an exploded perspective view of the lighting device according to the third exemplary embodiment of the present invention.
Figure 16:
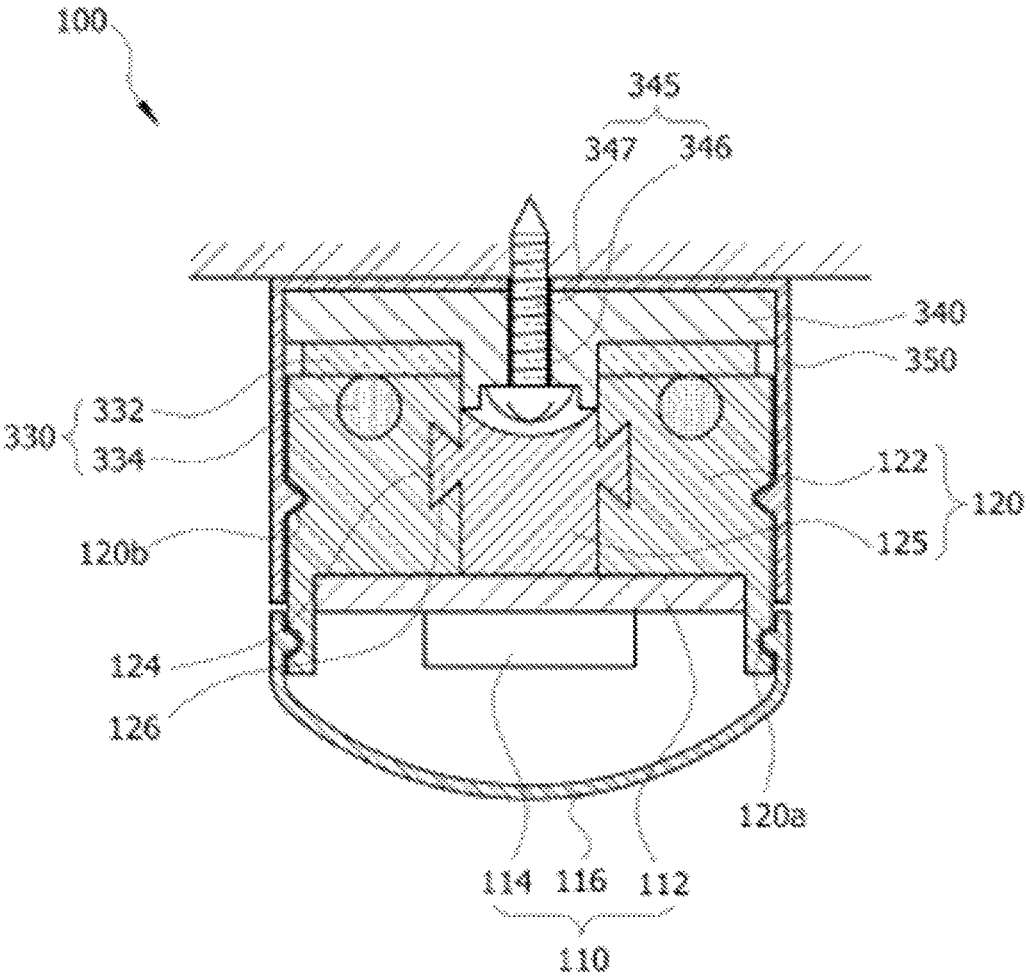
FIG. 16 is a cross-sectional view taken along line D-D of FIG. 14.
Figure 17:
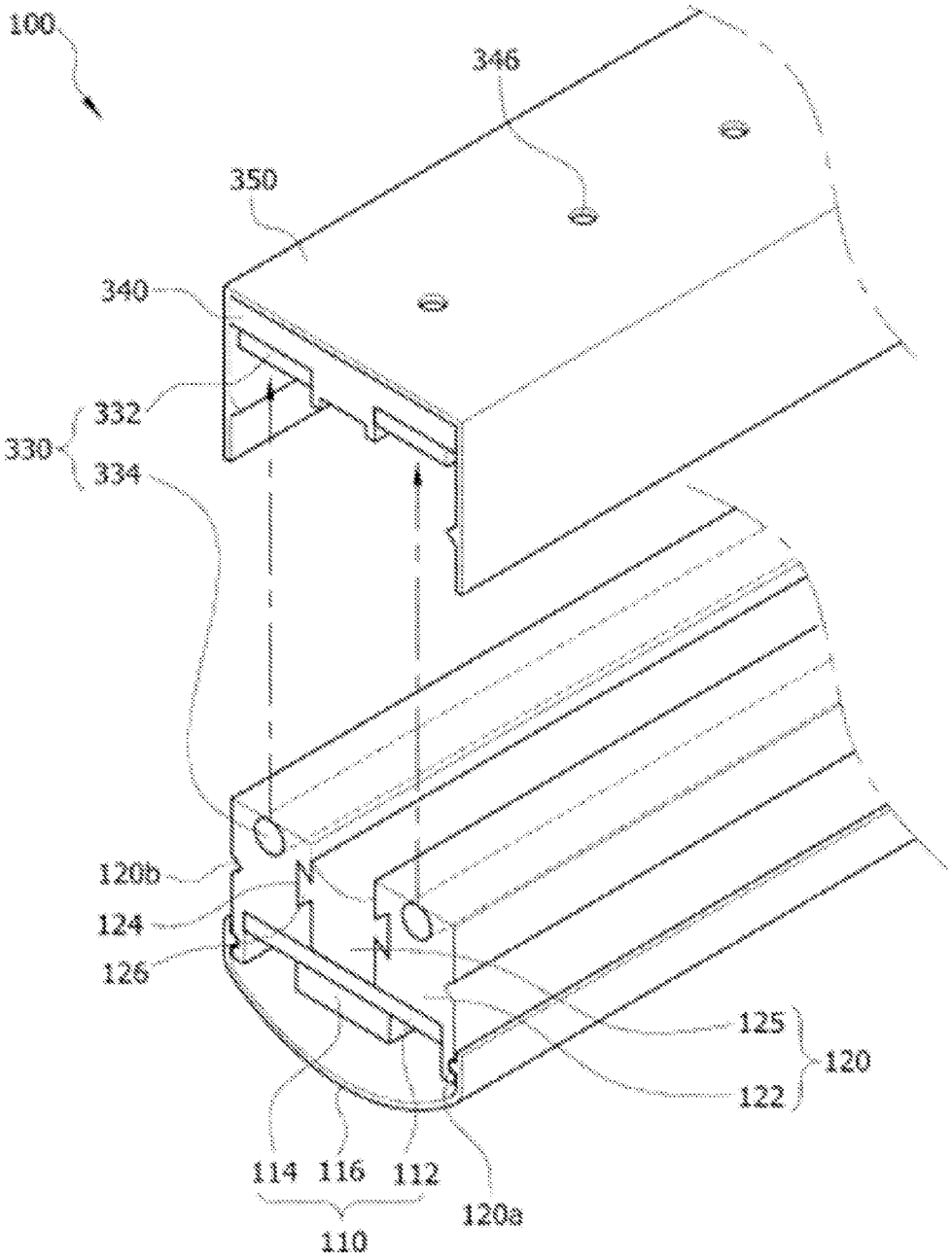
FIG. 17 is a perspective view showing the installation of the lighting device according to the third exemplary embodiment of the present invention.
Figure 18:
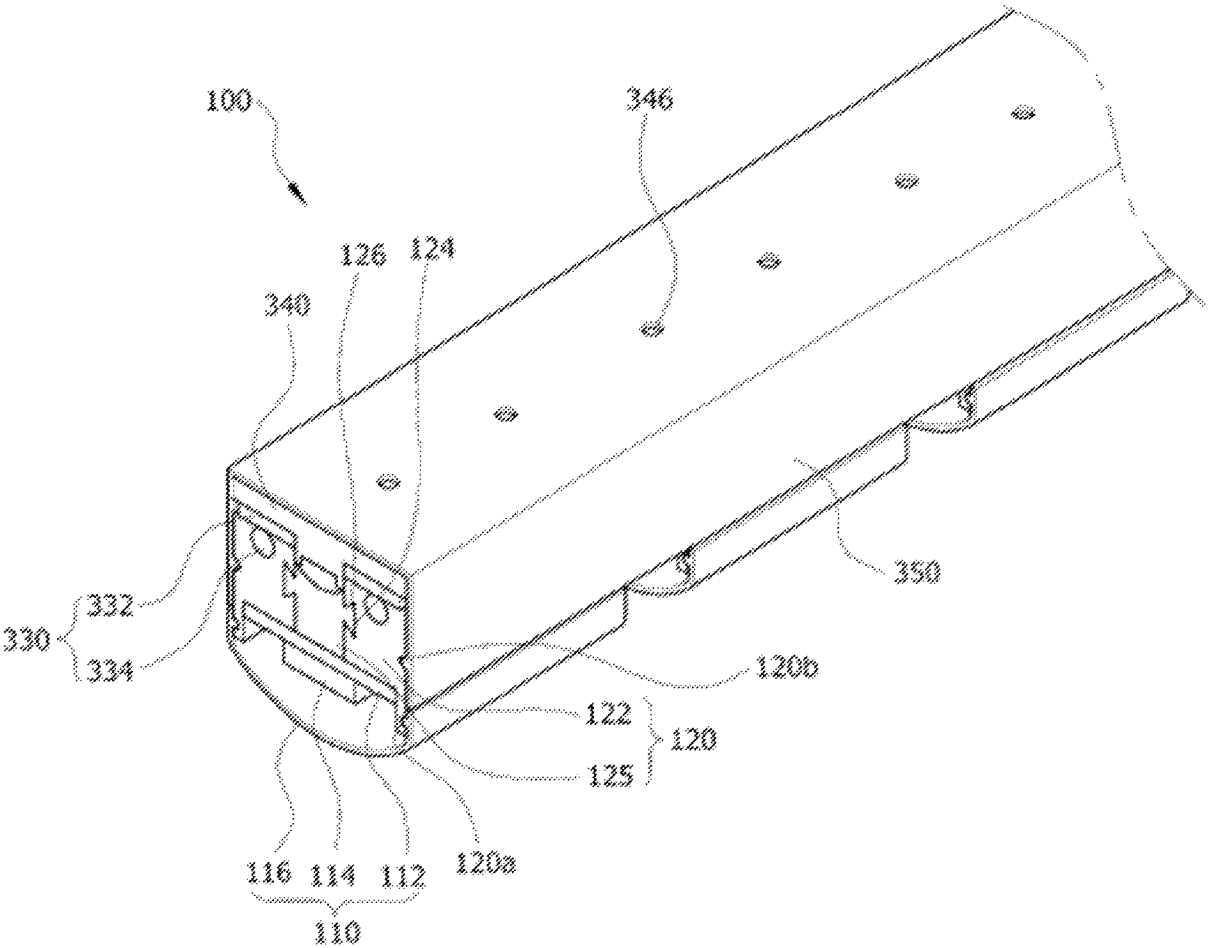
FIG. 18 illustrates the lighting device according to the third exemplary embodiment of the present invention in use.

FIG. 14 is a perspective view of the lighting device according to the third exemplary embodiment of the present invention, FIG. 15 is an exploded perspective view of the lighting device according to the third exemplary embodiment of the present invention, FIG. 16 is a cross-sectional view taken along line D-D of FIG. 14, FIG. 17 is a perspective view showing the installation of the lighting device according to the third exemplary embodiment of the present invention, and FIG. 18 illustrates the lighting device according to the third exemplary embodiment of the present invention in use.

Referring to FIG. 14 through FIG. 18, the lighting device 100 according to the third exemplary embodiment of the present invention is similar to the first exemplary embodiment described above, while the power supply part 330 includes electrodes 332 electrically connected with the power connection part 120, and magnets 334 arranged in the power connection part 120, the magnets 334 and the electrodes 332 being attached together.

The electrodes 332 are arranged in a bracket 340. The bracket 340 is comprised of a non-conducting plate, and secured onto a target fixed object by means of a fixing element 345. The fixing element 345 includes a fixing hole 346 formed at the center of the bracket 340, and a fastening member 347 to be locked onto the target fixed object, passing through the fixing hole 346. As the bracket 340 is comprised of a thin plate, the fixing hole 346 protrudes a certain thickness from the center of the bracket 340, in order to maintain rigidity of the bracket 340. The fastening member 347 is comprised of a screw which passes through the fixing hole 346 and threadedly engaged in the target fixed object. The fixing hole 346 has a recessed portion to receive the head of the fastening member 347.

The electrodes 332 extends in the longitudinal direction of the bracket 340 to a certain extent so that it has an equivalent length of the bracket 340, and is electrically connected to an outside power source (not shown) to receive power. Particularly, as shown in FIG. 16, the electrodes 332 are arranged side by side in the bracket 340, being spaced a distance away from each other. They are electrically connected to a pair of power connectors 122, and this arrangement is intended to make a plane contact. In this embodiment, the electrodes 332 are formed of metallic sheets, for example, which can be attached using magnetic force.

The magnet 334 is built within the power connection part 120, along the longitudinal direction of the power connection part 120, as shown in FIG. 15. With this design, the power connectors 122 and the electrodes 332 may have a plane contact with each other, and stable power supply can thus be accomplished. The magnetic force of the magnet 334 has a magnitude sufficient to bear the load of the power connection part 120 and the illumination part 110.

The bracket 340 further includes a clamping member 350 for fixing the power connection part 120. The clamping member 350 has an upside down U-shaped cross section, exhorting resilient force from its both lateral faces, and surrounds and further fixes the power connection part 120 accordingly. The clamping member 350 is placed between the bracket 340 and the target fixed object, and fixed, together with the bracket 340, onto the target fixed object by means of the fastening member 347. The peripheral sides of the power connector 122 and the clamping member 350 are locked against the projected shoulder 120*b* of the power connection part 120, and the power connection part 120 is thus fixed. In this manner, the clamping part, together with the magnet 334 provided in the power connector 122, can firmly fix the power connection part 120 and the illumination part 110.

Figure 19:
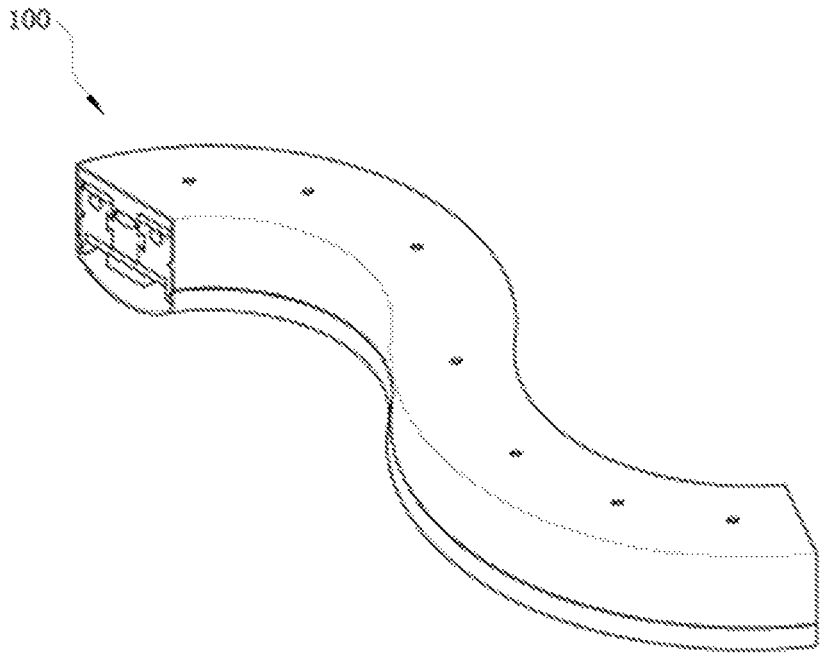
FIG. 19 is a first modified version of the lighting device according to the third exemplary embodiment of the present invention.
Figure 20:
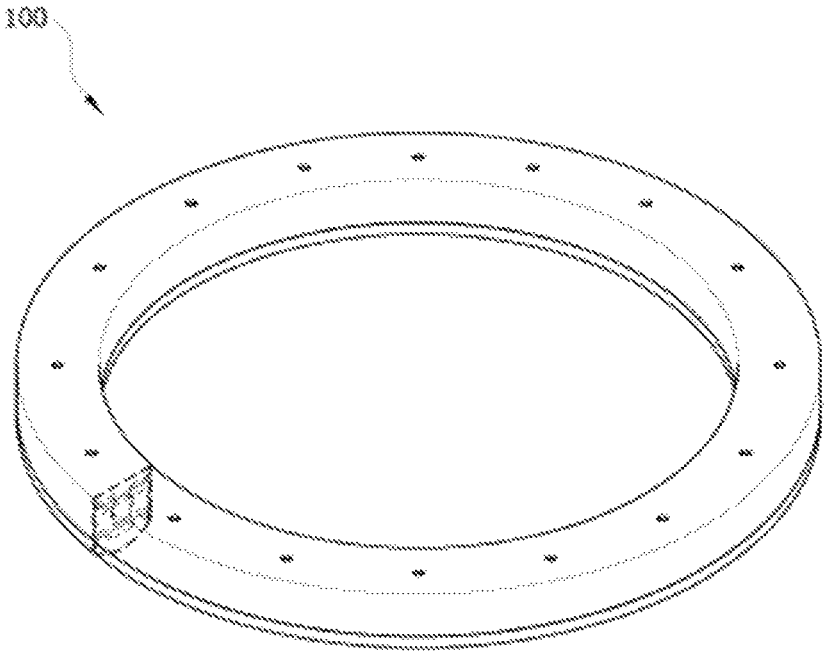
FIG. 20 is a second modified version of the lighting device according to the third exemplary embodiment of the present invention.

FIG. 19 is a first modified version of the lighting device according to the third exemplary embodiment of the present invention, and FIG. 20 is a second modified version of the lighting device according to the third exemplary embodiment of the present invention.

As shown in FIG. 19 and FIG. 20, the lighting device 100 of diverse shapes may be provided as the power connection part 120 and the illumination part 110 may have different shapes, depending on the shape of the bracket 340.

The following will now describe the operation and advantages of the lighting device according to the third exemplary embodiment of the present invention having the above structure.

Similar to the first exemplary embodiment, the third exemplary embodiment also has a pair of power connectors 122, each being connected to the first insulation block 125, and the power connectors 122 together with the illumination part 110 provided therein are modularized.

The bracket 340 can be installed on the target fixed object. In other words, it can be installed on the ceiling or a separate structure. The bracket 340 is made in a plate shape, and secured onto the target fixed object by means of the fixing element 345. Here, the bracket 340 as well as the clamping member 350 are fixed together by means of the fixing element 345. The bracket 340 has a fixing hole 346 at the center, and the fastening member 347 passes through the fixing hole 346 and can lock the bracket 340 and the clamping member 350 at the same time.

To obtain lighting, the modularized power connection part 120 and illumination part 110 are mounted in the bracket 340 and clamping member 350 installed on the target fixed object. Then outside power is supplied to the power connection part 120 via the power supply part 330.

The power supply part 330 is comprised of the electrodes 332 arranged in the bracket 340, and the magnets 334 provided in the power connectors 122. As such, outside or external power is supplied to the power connector 122 being attached to the electrode 332 by magnetic force from the magnet 334, and lighting can therefore be obtained (see FIG. 16).

In addition to the magnetic force from the magnet 334 provided in the power connector 122, the resilient force of the clamping member 350 itself are used to surround the power connection part 120, and interlocking by means of the projected shoulder 120*b* of the power connector 122 and the clamping member 350 allows the lighting device to be fixed firmly.

Moreover, as the electrodes 332 and the power connectors 122 make a surface contact and thus touch each other as they are arranged in succession, power can be supplied stably, which in turn prevents poor contact of power and improves product reliability.

Meanwhile, as shown in FIG. 19 and FIG. 20, the power connection part 120 and the illumination part 110 may be shaped corresponding to the shape of the bracket 340, thereby providing either bent or circular lighting.

The following will now describe a lighting device according to a fourth exemplary embodiment of the present invention, with reference to the drawings.

For the convenience of explanation, like or similar elements having the same function and configuration as those in the first exemplary embodiment will be designated by the same reference numerals, and further detailed description on them will be omitted accordingly.

Figure 21:
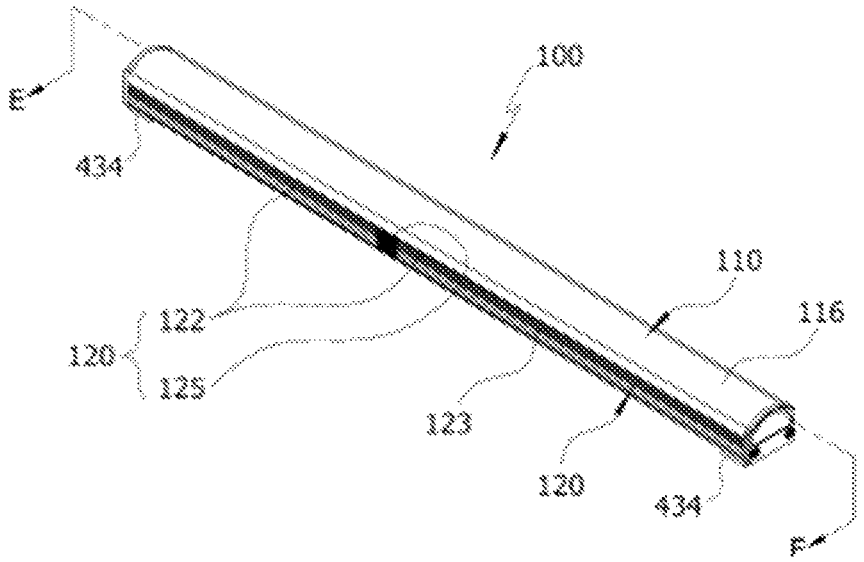
FIG. 21 is a perspective view of a lighting device according to a fourth exemplary embodiment of the present invention.
Figure 22:
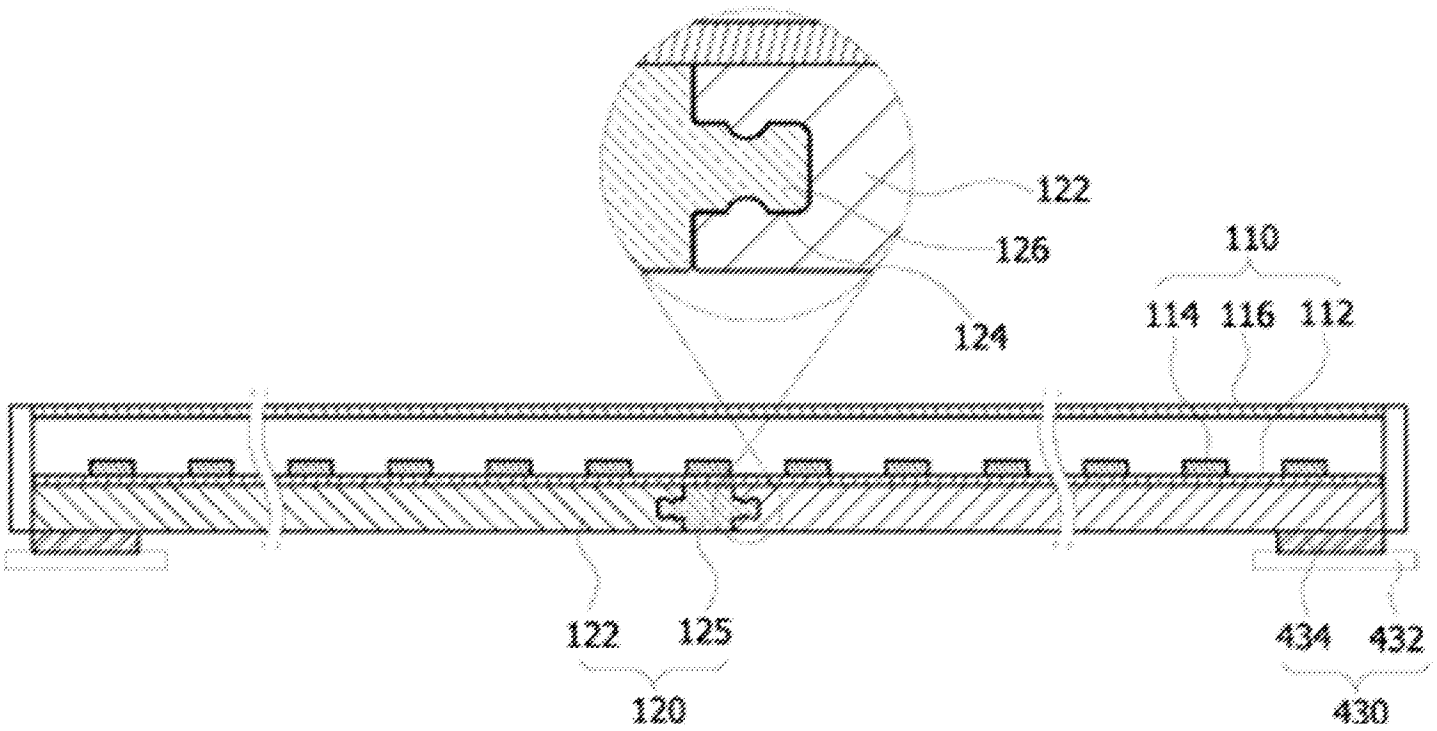
FIG. 22 is a cross-sectional view taken along line E-E of FIG. 21.
Figure 23:
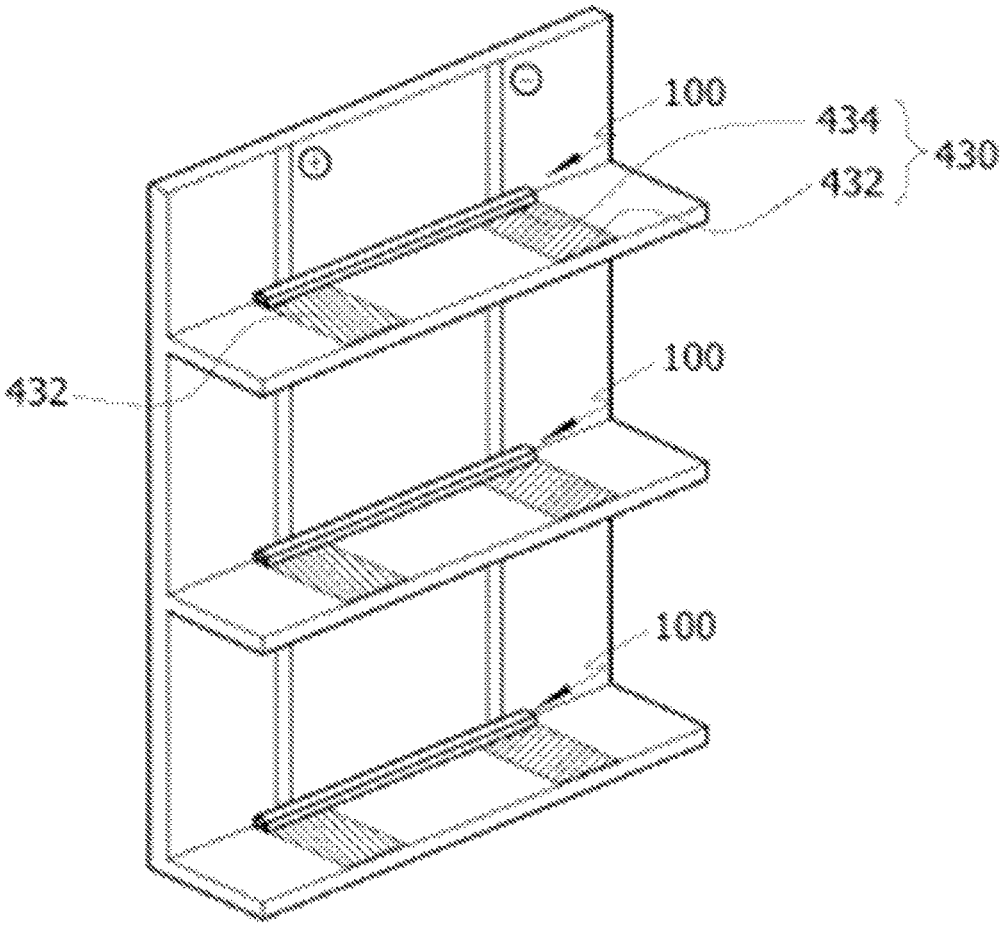
FIG. 23 shows a state that the lighting device according to the fourth exemplary embodiment of the present invention is installed in a piece of furniture.

FIG. 21 is a perspective view of a lighting device according to a fourth exemplary embodiment of the present invention, FIG. 22 is a cross-sectional view taken along line E-E of FIG. 21, and FIG. 23 shows a state that the lighting device according to the fourth exemplary embodiment of the present invention is installed in a piece of furniture.

Referring to FIG. 21 through FIG. 23, the lighting device 100 according to the fourth exemplary embodiment of the present invention is similar to the first exemplary embodiment of the present invention, while the power connectors 122 and the first insulation block 125 in the first exemplary embodiment are being coupled and decoupled in the longitudinal direction, the power connectors 122 and the first insulation block 125 in the fourth exemplary embodiment are being coupled and decoupled in the width direction.

Like the power supply part 330 in the third exemplary embodiment, the power supply part 430 includes electrodes 432 electrically connected to the power connection part 120, and magnets 434 arranged in the power connection part 120, the magnets 434 and the electrodes 432 being attached together. That is, the magnets 434 are arranged on the front face of the power connector 122 in a manner that the magnets 434 make a surface contact with the power connector 122 and further with the electrode 432.

More specifically, the magnets 434 are installed on the lower portion of the power connector 122 on either side. The magnets 434 are made of electrically conducting materials and thus are capable of transferring current to the power connector 122 as different electrodes are applied to the magnets 434 attached on either side.

Referring to FIG. 23, this embodiment may be used as being attached to a part to which the power is supplied, e.g., electrodes 432 in a piece of furniture to which the power is supplied from an outside power source, simply by using magnets 434. In other words, the lighting device 100 has magnets 434 on the front face of each of the power connector 122, and the magnets 434 comes into contact with the electrodes 432, respectively, available in the furniture to transfer power to the power connector 122, as shown in the drawing.

Figure 24:
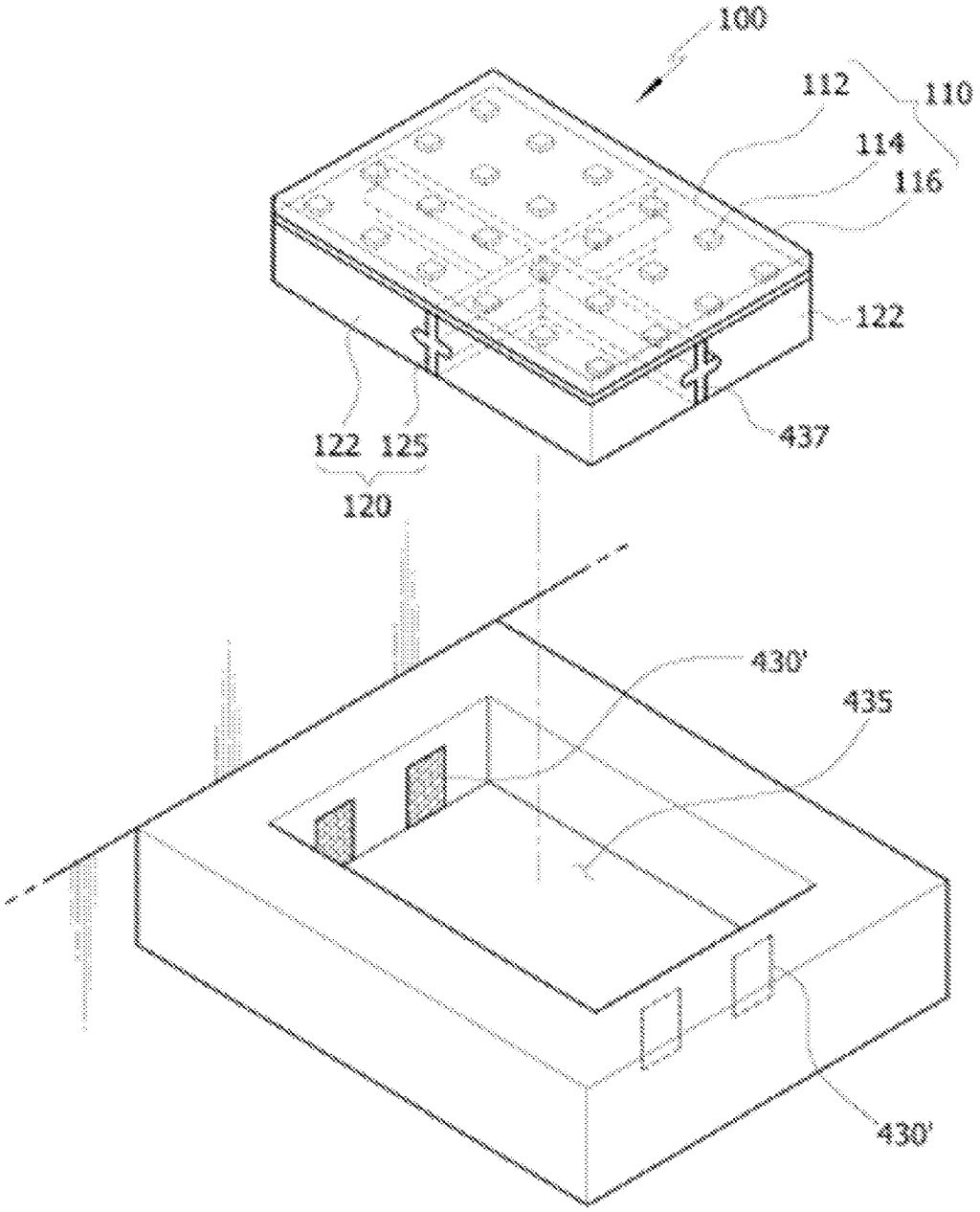
FIG. 24 is a first modified version of the lighting device according to the fourth exemplary embodiment of the present invention.
Figure 25:
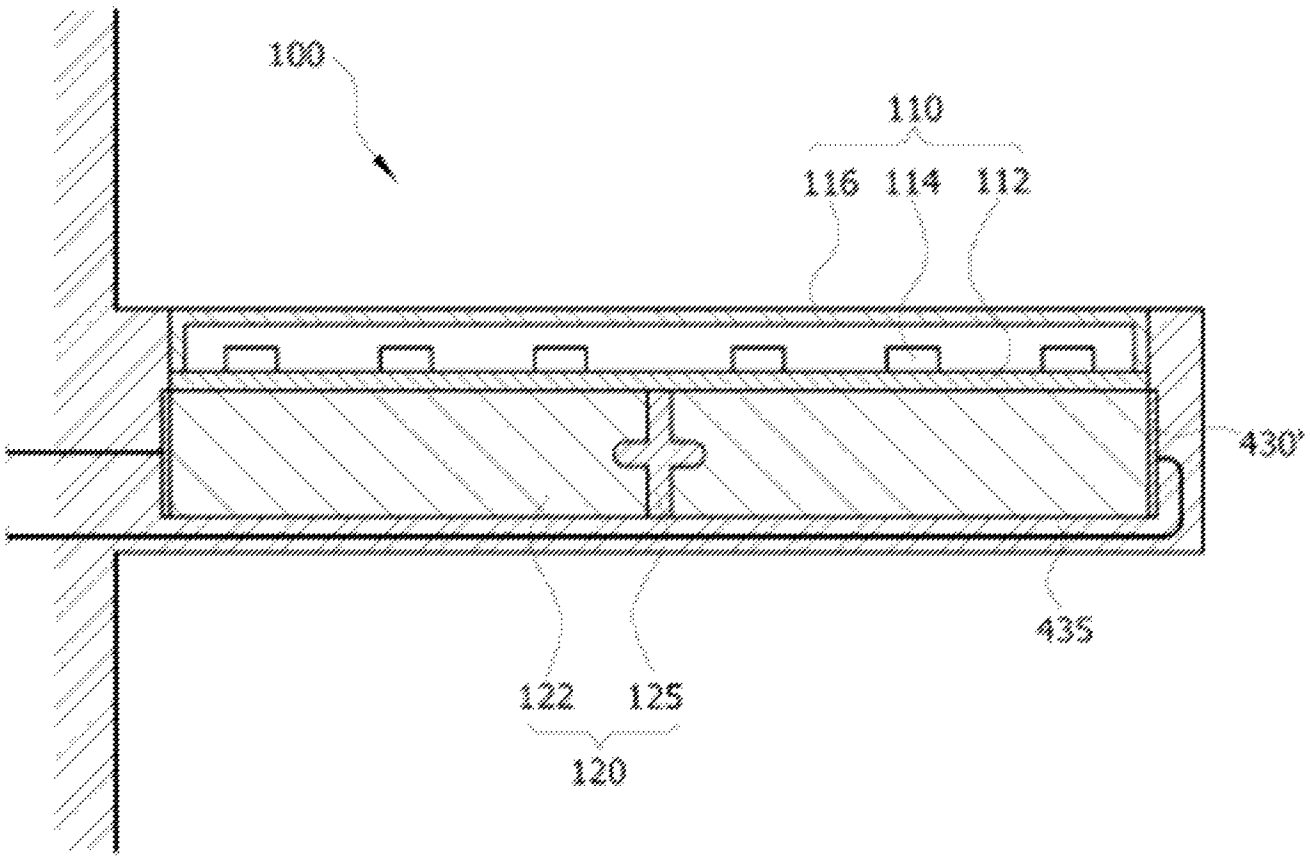
FIG. 25 is a cross-sectional view showing a joined state of the lighting device of FIG. 24.
Figure 26:
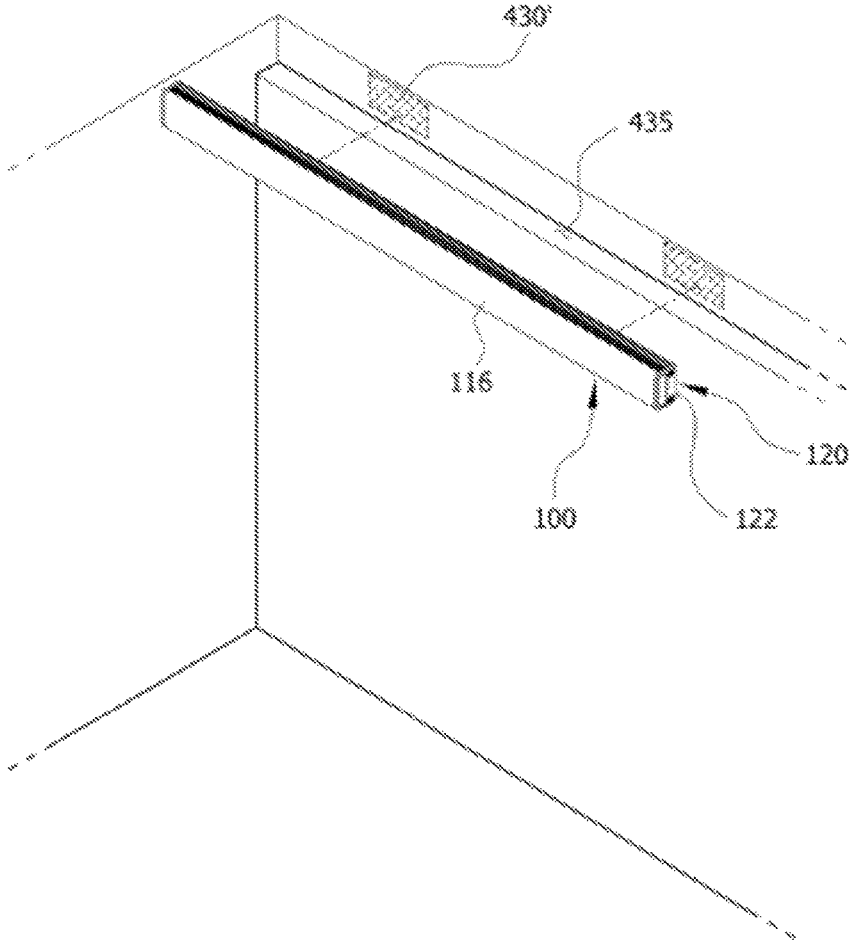
FIG. 26 is a second modified version of the lighting device according to the fourth exemplary embodiment of the present invention.
Figure 27:
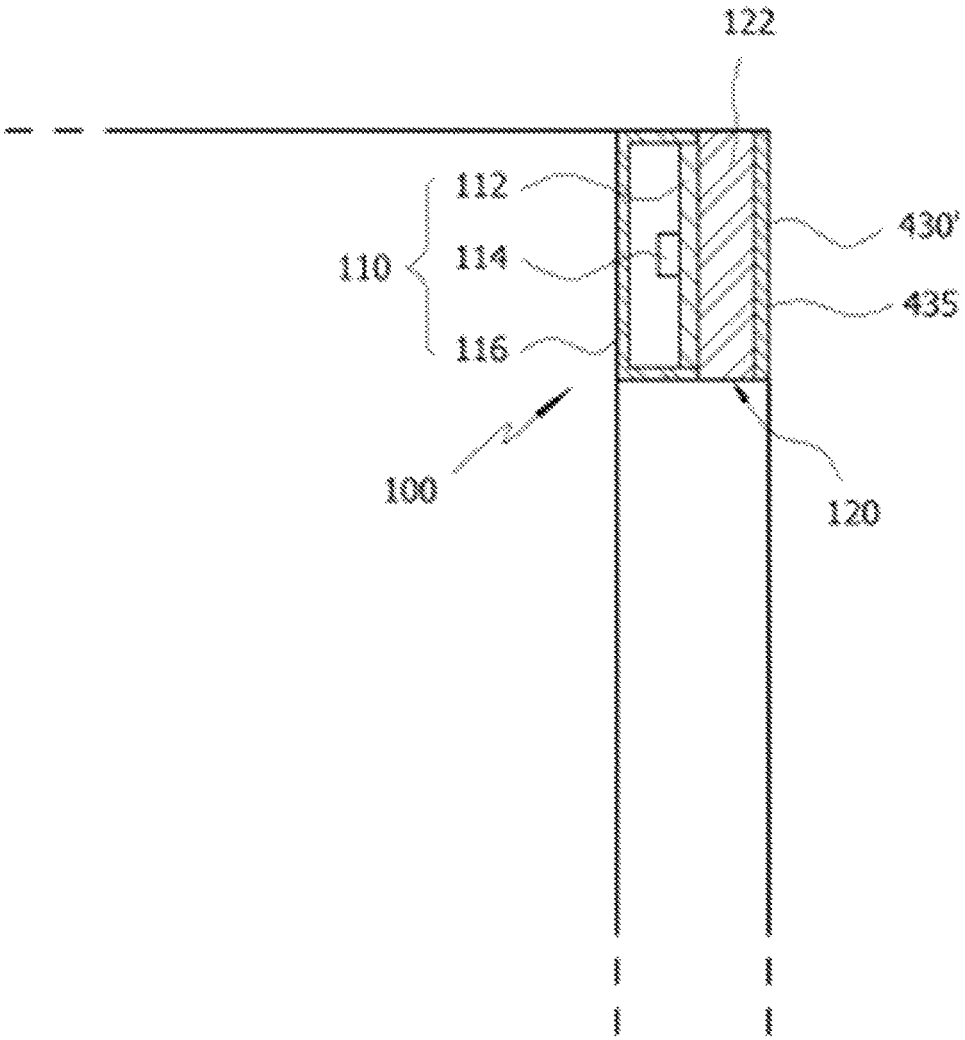
FIG. 27 is a cross-sectional view showing a joined state of the lighting device of FIG. 26.

FIG. 24 is a first modified version of the lighting device according to the fourth exemplary embodiment of the present invention, FIG. 25 is a cross-sectional view showing a joined state of the lighting device of FIG. 24, FIG. 26 is a second modified version of the lighting device according to the fourth exemplary embodiment of the present invention, and FIG. 27 is a cross-sectional view showing a joined state of the lighting device of FIG. 26.

Referring to FIG. 24 through FIG. 27, a receiving recess 435 is formed in a target fixed object, and the lighting device 100 is arranged in the receiving recess 435. For example, FIG. 24 and FIG. 25 illustrate that the lighting device 100 is arranged in a piece of furniture as the target fixed object, and FIG. 26 and FIG. 27 illustrate that the lighting device 100 is mounted on the wall as the target fixed object.

Referring again to FIG. 24 and FIG. 25, the receiving recess 435 is sunken in the target fixed object, and a power supply part 430' formed of an electrode is placed on the lateral faces or bottom face of the receiving recess 435. The power supply part 430' and the power connector 122 are electrically connected and can receive outside power, simply by placing the lighting device 100 in the receiving recess 435. The diffusion member 116 of the illumination part 110 may be formed in a planar shape in parallel with the surface of the target fixed object, such that an advertising article for example can be displayed on the object.

Here, there are multiple power connection parts 120, and each is spaced from the nearest neighboring power connection part 120 by a second insulation block 437. The second insulation block 437 may be formed separately from the first insulation block 125, or unitarily with the first insulation block 125 as shown in FIG. 24. The second insulation block 437 may be comprised of the same insulator as the first insulation block 125.

That is, multiple power connectors 122 may be insulated horizontally and vertically by the first and second insulation blocks 125 and 437, and this is possible because power can be supplied to the power supply part 430' arranged on the lateral or bottom face of the receiving recess 435.

Further, referring to FIG. 26 and FIG. 27, the receiving recess 435 is formed in the wall as the target fixed object, and the power supply part 430' is arranged in the receiving recess 435. The receiving recess 435 is obtained by attaching to the wall a panel shorter than the height of the wall, thereby creating the receiving recess 435 as thick as the panel.

The power supply part 430' is made of a conducting tape connected with an outside power source. As the power supply part 430' is made of a conducting tape, the power connector 122 can receive outside power simply by being attached thereto. Because of this, magnets for attaching the lighting device 100 may be omitted.

The lighting device 100 may be installed on a level with the wall by embedding the lighting device 100 without a finishing member.

Alternatively, the power supply part 430' in the second modified version may be comprised of a conductive tape similar to the first modified version. In this case, the lighting device 100 may be fixed firmly.

The following will now describe the operation and advantages of the lighting device according to the fourth exemplary embodiment of the present invention having the above structure.

Similar to the first exemplary embodiment, the fourth exemplary embodiment has a pair of power connectors 122, each being connected to the first insulation block 125. The power connectors 122 together with the illumination part 110 provided therein are modularized.

As already shown in FIG. 23, again in this embodiment, magnets 434 are arranged at the power connector 122, and electrodes 432 are arranged at a piece of furniture as the target fixed object, the magnets 434 being attached to the electrodes 432 of the furniture by magnetic force and allowing the supply of power.

For example, when plus (+) power is applied to one side of the shelf of the furniture and minus (−) power is applied to the other side of the shelf of the furniture, the power connectors 122, the power connectors 122 are attached by means of the magnets 434 arranged at the power connectors 122, respectively, and the power is thus supplied to the illumination part 110 that can then be used for lighting. The surface contact made between these magnets 434 and the electrodes 432 allows stabilized power supply. This can be advantageous for providing a variety of lights and further optimizing an advertising effect of the product, if a product is displayed in a showcase.

Also, referring to FIG. 24 and FIG. 25, the lighting device 100 can be placed in the receiving recess 435 formed in the target fixed object. The lighting device 100 placed in the receiving recess 435 is electrically connected by means of power supply parts 430' arranged at the lateral or bottom face of the receiving recess 435, such that the lighting device 100 in the receiving recess 435 can be used for lighting. The diffusion member 116 in the illumination part 110 is held on a level with the target fixed object where an advertising article may be displayed.

Multiple power connection parts 120 may be arranged in the receiving recess 435 as the power connection parts 120 are insulated by the second insulation blocks 437, and this in turn makes it possible to embody a variety of lights.

Further, referring to FIG. 26 and FIG. 27, the lighting device 100 may be placed in the receiving recess 435 defined by panels on the wall, and used for indoor lighting. To make this work, the power connectors 122 are directly attached by means of a conducting tape as the power supply part 430' that is electrically connected to an outside power source. The diffusion member 116 in the illumination part 110 has a planar shape and is arranged on a level with the target fixed object, and the lighting device 100 can thus be used as being embedded state without a finishing member, thereby finding its applications not only for lighting but also for a design element.

Figure 28:
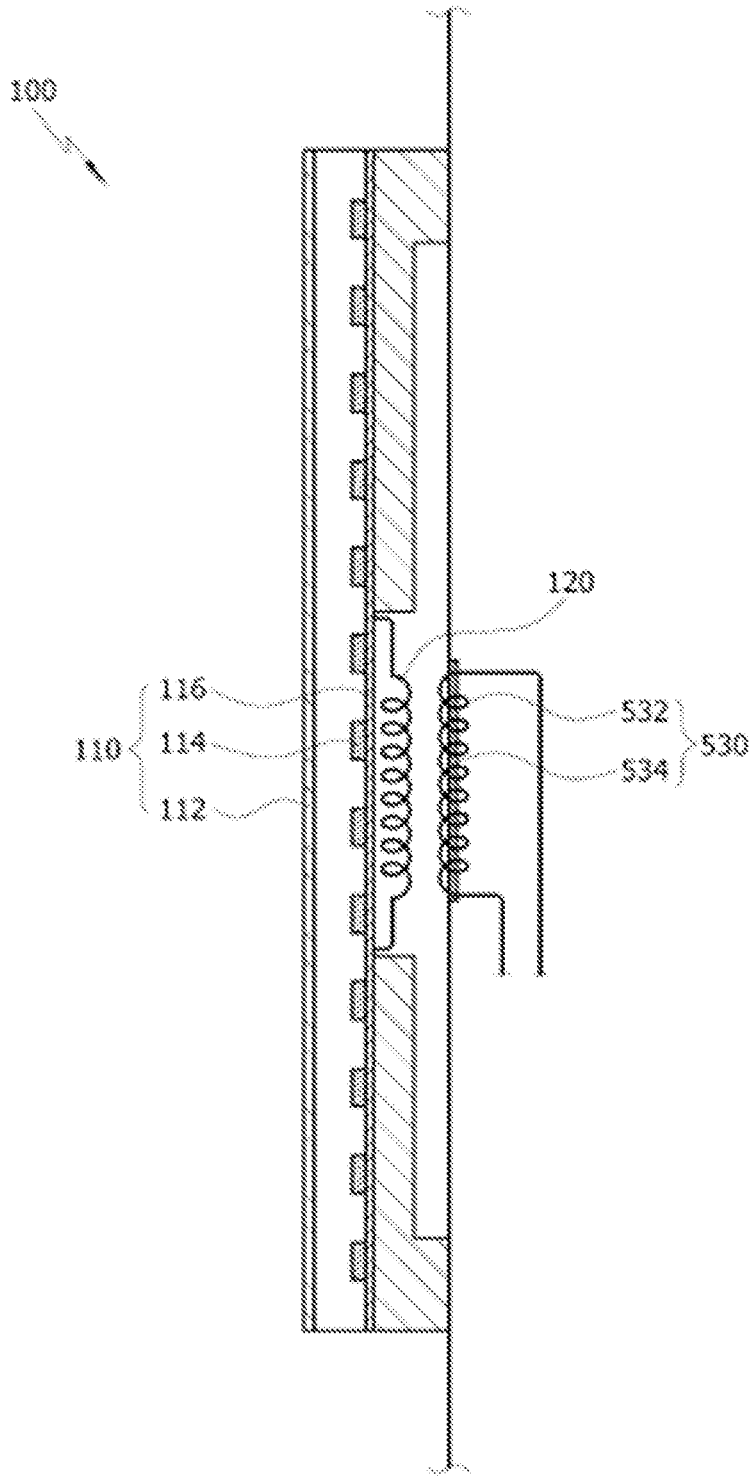
FIG. 28 is a cross-sectional view of a lighting device according to a fifth exemplary embodiment of the present invention.

FIG. 28 is a cross-sectional view of a lighting device according to a fifth exemplary embodiment of the present invention. Referring to FIG. 28, the lighting device 100 according to the fifth exemplary embodiment of the present invention is similar to the first exemplary embodiment, while the former includes a power supply part 530 which is arranged at a distance from the power connection part 120 and includes a coil portion 532 to which an outside power is supplied and a magnet 534 provided in the coil portion 532.

With the magnet 534 being arranged within the coil portion 532 to which an outside power is applied, power can be supplied to the power connection part 120 by electromagnetic induction. Here, the power connection part 120 is comprised of a coil provided in the illumination part 110.

To explain the operation of the aforementioned lighting device according to the fifth exemplary embodiment, the power supply part 530 comprised of the coil portion 532 and the magnet 534 is arranged at a target fixed object, and the power connection part 120 comprised of the power supply part 530 and the coil can receive power from the power supply part 530 by electromagnetic induction in a non-contact manner.

As described above, the lighting device according to the present invention has a simplified structure, allowing easy assembly/disassembly and installation, and features accurate power supply to provide a high-reliability lighting device. Further, it is designed to allow partial replacement, i.e. only a damaged part is replaced, thereby being more economical. In addition, multiple lighting devices can be connected and operated by a single power supply, and this in turn makes it possible to provide a variety of lights.

While the present invention has been described with reference to exemplary embodiments shown in the accompanying drawings, this is only by way of illustration and not of limitation. Therefore, a person skilled in the art should understand that the present invention is to cover all modifications and equivalents that fall within the spirit and scope of the invention.

Accordingly, the true spirit and scope of the present invention will be protected and defined by the appended claims.

The invention claimed is:

1. A lighting device comprising:

an illumination part; and a power connection part adapted to supply external power to the illumination part and to prevent an electrical short circuit, the power connection part including at least two power connectors which are separated from each other and into which the external power is transferred and an insulator provided between the at least two power connectors and coupled with the at least two power connectors;

wherein the illumination part includes a circuit board and the circuit board is provided directly on the at least two power connectors; and, a diffusion member is directly connected with the at least two power connectors.

2. The lighting device according to claim 1, wherein the at least two power connectors are provided with a heat dissipation portion with protrusions and depressions.

3. The lighting device according to claim 1, further comprising:

an additional insulator electrically insulating and coupling the at least two power connectors and being formed separately from the insulator or unitarily with the insulator.

4. The lighting device according to claim 1, further comprising:

a power supply part to supply the external power to the power connection part.

5. The lighting device according to claim 4, wherein the power supply part is provided below the power connection part.

6. The lighting device according to claim 4, wherein the power supply part is provided beside the at least two power connectors.

7. The lighting device according to claim 4, wherein the power supply part is electrically connected with a neighboring lighting device, and the power supply part is flexible.

8. The lighting device according to claim 4, wherein the power connection part and the power supply part are attached together by a magnet.

9. The lighting device according to claim 4, wherein the power supply part is locked on an inner face of the at least two power connectors.

10. The lighting device according to claim 4, wherein the power supply part is provided with a power supply pin locked on an outer face of the at least two power connectors.

11. The lighting device according to claim 4, wherein the power supply part is provided with at least two electrodes making a surface contact with the at least two power connectors.

12. The lighting device according to claim 4, further comprising:

a bracket to prevent the escape of the power supply part from the power connection part.

13. The lighting device according to claim 4, wherein the power connection part is provided with a magnet.

14. The lighting device according to claim 4, wherein the power supply part is provided with at least two electrodes connected with the at least two power connectors and a bracket on which the at least two electrodes are provided, the bracket being in a plate shape.

15. The lighting device according to claim 4, wherein the power supply part is provided with a coil portion and a magnet.

* * * * *